US011096443B2

(12) United States Patent
Connell et al.

(10) Patent No.: US 11,096,443 B2
(45) Date of Patent: Aug. 24, 2021

(54) SOLE STRUCTURE FOR ARTICLE OF FOOTWEAR

(71) Applicant: NIKE, Inc., Beaverton, OR (US)

(72) Inventors: Jeremy L. Connell, Hillsboro, OR (US); Karen S. Dimoff, Portland, OR (US); Stefan E. Guest, Portland, OR (US); Charlie Keller, Beaverton, OR (US); Troy C. Lindner, Portland, OR (US); Geng Luo, Portland, OR (US); Tetsuya T. Minami, Portland, OR (US); Jonathan Rasca, Beaverton, OR (US); Adam Thuss, Portland, OR (US)

(73) Assignee: NIKE, Inc., Beaverton, OR (US)

( * ) Notice: Subject to any disclaimer, the term of this patent is extended or adjusted under 35 U.S.C. 154(b) by 191 days.

(21) Appl. No.: 16/270,279

(22) Filed: Feb. 7, 2019

(65) Prior Publication Data

US 2019/0246738 A1 Aug. 15, 2019

Related U.S. Application Data

(60) Provisional application No. 62/628,688, filed on Feb. 9, 2018.

(51) Int. Cl.
*A43B 13/18* (2006.01)
*A43B 13/02* (2006.01)
(Continued)

(52) U.S. Cl.
CPC ..... *A43B 13/026* (2013.01); *A43B 13/183* (2013.01); *A43B 13/184* (2013.01);
(Continued)

(58) Field of Classification Search
CPC ..... A43B 13/20; A43B 13/203; A43B 13/206; A43B 13/183; A43B 13/026
See application file for complete search history.

(56) References Cited

U.S. PATENT DOCUMENTS 5,461,800 A * 10/1995 Luthi ..... A43B 13/181 36/114
7,484,317 B2 * 2/2009 Kita ..... A43B 13/10 36/27
(Continued)

FOREIGN PATENT DOCUMENTS

AT 387695 B 2/1989
CN 101048086 A 10/2007
(Continued)

OTHER PUBLICATIONS

European Patent Office as the ISA, International Search Report for PCT Application No. PCT/US2019/017149, dated May 20, 2019.
(Continued)

*Primary Examiner* — Ted Kavanaugh
(74) *Attorney, Agent, or Firm* — Homgman LLP; Matthew H. Szalach; Jonathan O'Brien

(57) ABSTRACT

A sole structure for an article of footwear includes a first plate having a first surface. The first plate includes a forefoot region at an anterior end, a heel region at a posterior end, and a mid-foot region. The sole structure further includes a second plate having a second surface opposing the first surface of the first plate. The second plate has a first end attached to the forefoot region of the first plate and a second end that is spaced apart from the first surface of the first plate. A cushion is disposed between the first plate and the second plate and has a first side attached to the first surface of the first plate and a second side attached to the second surface of second plate. The cushion extends continuously from a medial side of the sole structure to a lateral side of the sole structure.

20 Claims, 16 Drawing Sheets

(51) Int. Cl.
*A43B 23/02* (2006.01)
*A43B 13/20* (2006.01)

(52) U.S. Cl.
CPC ..... *A43B 13/186* (2013.01); *A43B 13/20* (2013.01); *A43B 23/0205* (2013.01); *A43B 23/0245* (2013.01)

(56) References Cited

U.S. PATENT DOCUMENTS

| | | | | |
|---|---|---|---|---|
| 2003/0069807 | A1* | 4/2003 | Lyden | A43B 7/22 705/26.5 |
| 2005/0268488 | A1* | 12/2005 | Hann | A43B 13/20 36/27 |
| 2008/0052965 | A1 | 3/2008 | Sato | |
| 2009/0235557 | A1* | 9/2009 | Christensen | A43B 3/24 36/29 |
| 2012/0233878 | A1* | 9/2012 | Hazenberg | A43B 13/189 36/29 |
| 2015/0047229 | A1* | 2/2015 | Elliott | A43B 13/127 36/102 |
| 2015/0327624 | A1 | 11/2015 | Grott et al. | |
| 2017/0280816 | A1 | 10/2017 | Lyden | |
| 2019/0320759 | A1* | 10/2019 | Conrad | A43B 13/186 |
| 2020/0378462 | A1* | 12/2020 | Rennex | A43B 13/181 |

FOREIGN PATENT DOCUMENTS

| | | | |
|---|---|---|---|
| CN | 104687640 | A | 6/2015 |
| CN | 106263277 | A | 1/2017 |
| WO | WO-2015175605 | A1 | 11/2015 |
| WO | WO-2017042846 | A1 | 3/2017 |

OTHER PUBLICATIONS

China Patent Office Office Action for Application Serial No. 201980012619.5 dated Jun. 2, 2021.

* cited by examiner

SOLE STRUCTURE FOR ARTICLE OF FOOTWEAR

CROSS REFERENCE TO RELATED APPLICATION

This application claims priority to U.S. Provisional Application Ser. No. 62/628,688, filed Feb. 9, 2018, the contents of which are incorporated by reference in its entirety.

FIELD

The present disclosure relates generally to articles of footwear and more particularly to a sole structure for an article of footwear.

BACKGROUND

This section provides background information related to the present disclosure which is not necessarily prior art.

Articles of footwear conventionally include an upper and a sole structure. The upper may be formed from any suitable material(s) to receive, secure, and support a foot on the sole structure. The upper may cooperate with laces, straps, or other fasteners to adjust the fit of the upper around the foot. A bottom portion of the upper, proximate to a bottom surface of the foot, attaches to the sole structure.

Sole structures generally include a layered arrangement extending between a ground surface and the upper. One layer of the sole structure includes an outsole that provides abrasion-resistance and traction with the ground surface. The outsole may be formed from rubber or other materials that impart durability and wear-resistance, as well as enhancing traction with the ground surface. Another layer of the sole structure includes a midsole disposed between the outsole and the upper. The midsole provides cushioning for the foot and is generally at least partially formed from a polymer foam material that compresses resiliently under an applied load to cushion the foot by attenuating ground-reaction forces. The midsole may define a bottom surface on one side that opposes the outsole and a footbed on the opposite side that may be contoured to conform to a profile of the bottom surface of the foot. Sole structures may also include a comfort-enhancing insole and/or a sockliner located within a void proximate to the bottom portion of the upper.

Midsoles using polymer foam materials are generally configured as a single slab that compresses resiliently under applied loads, such as during walking or running movements. Generally, single-slab polymer foams are designed with an emphasis on balancing cushioning characteristics that relate to softness and responsiveness as the slab compresses under gradient loads. Polymer foams providing cushioning that is too soft will decrease the compressibility and the ability of the midsole to attenuate ground-reaction forces after repeated compressions. Conversely, polymer foams that are too hard and, thus, very responsive, sacrifice softness, thereby resulting in a loss in comfort. While different regions of a slab of polymer foam may vary in density, hardness, energy return, and material selection to balance the softness and responsiveness of the slab as a whole, creating a single slab of polymer foam that loads in a gradient manner from soft to responsive is difficult to achieve.

DESCRIPTION OF THE DRAWINGS

The drawings described herein are for illustrative purposes only of selected embodiments and not all possible implementations, and are not intended to limit the scope of the present disclosure.

Corresponding reference numerals indicate corresponding parts throughout the several views of the drawings.

DETAILED DESCRIPTION

Figure 1:
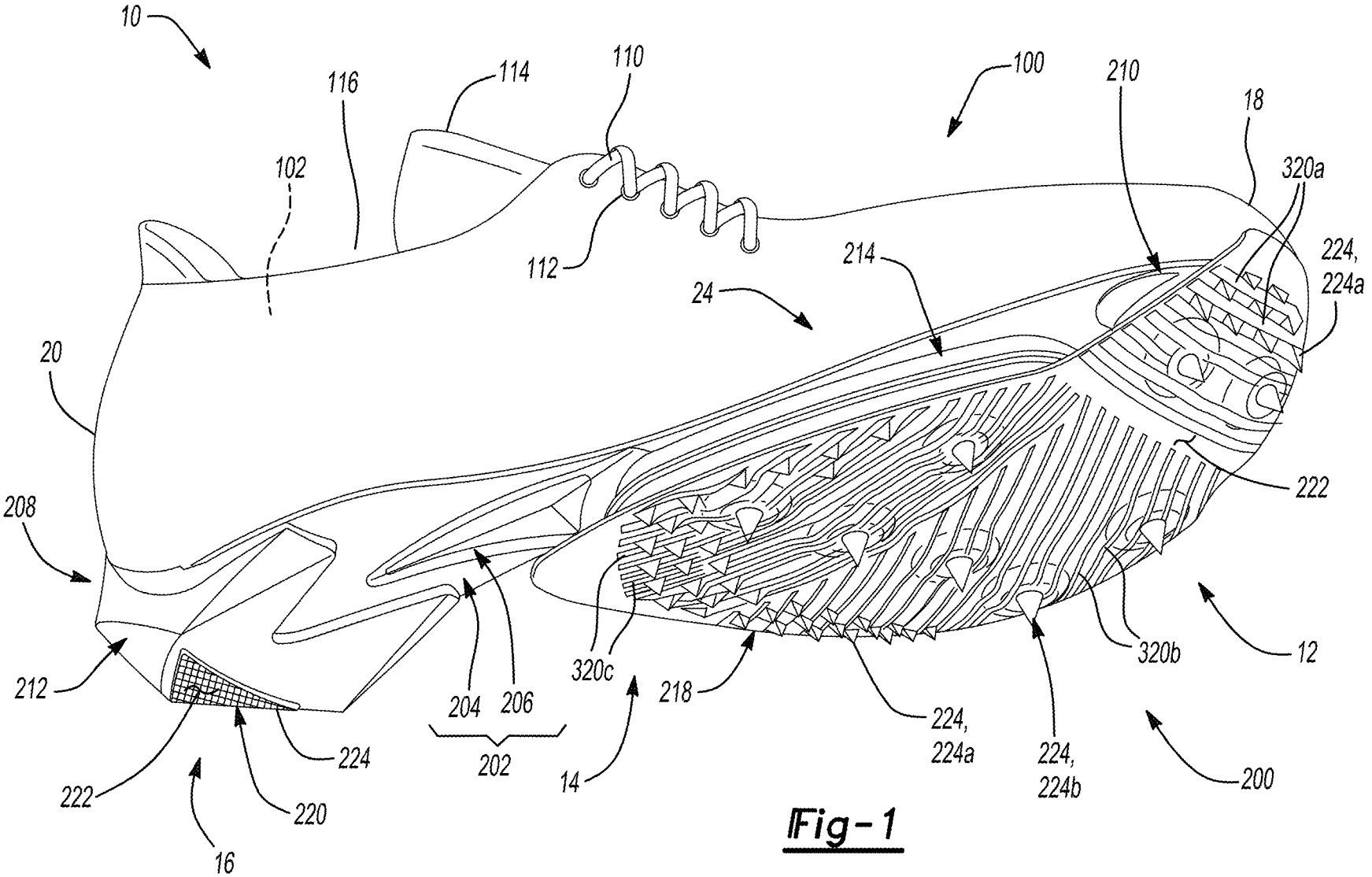
FIG. 1 is a perspective view of an article of footwear incorporating a sole structure in accordance with the principles of the present disclosure.

Example embodiments will now be described more fully with reference to the accompanying drawings. Example embodiments are provided so that this disclosure will be thorough, and will fully convey the scope of those who are skilled in the art. Numerous specific details are set forth such as examples of specific components, devices, and methods, to provide a thorough understanding of embodiments of the present disclosure. It will be apparent to those skilled in the art that specific details need not be employed, that example embodiments may be embodied in many different forms and that neither should be construed to limit the scope of the disclosure. In some example embodiments, well-known processes, well-known device structures, and well known technologies are not described in detail.

The terminology used herein is for the purpose of describing particular example embodiments only and is not intended to be limiting. As used herein, the singular forms "a," "an," and "the" may be intended to include the plural forms as well, unless the context clearly indicates otherwise. The terms "comprises," "comprising," "including," and "having," are inclusive and therefore specify the presence of features, integers, steps, operations, elements, and/or components, but do not preclude the presence or addition of one or more other features, integers, steps, operations, elements, components, and/or groups thereof. The method steps, processes, and operations described herein are not to be construed as necessarily requiring their performance in the particular order discussed or illustrated, unless specifically identified as an order of performance. It is also to be understood that additional or alternative steps may be employed.

When an element or layer is referred to as being "on," "engaged to," "connected to," or "coupled to" another element or layer, it may be directly on, engaged, connected or coupled to the other element or layer, or intervening elements or layers may be present. In contrast, when an element is referred to as being "directly on," "directly engaged to," "directly connected to," or "directly coupled to" another element or layer, there may be no intervening elements or layers present. Other words used to describe the relationship between elements should be interpreted in a like fashion (e.g., "between" versus "directly between," "adjacent" versus "directly adjacent," etc.). As used herein, the term "and/or" includes any and all combinations of one or more of the associated listed items.

Although the terms first, second, third, etc. may be used herein to describe various elements, components, regions, layers and/or sections, these elements, components, regions, layers and/or sections should not be limited by these terms. These terms may be only used to distinguish one element, component, region, layer or section from another region, layer or section. Terms such as "first," "second," and other numerical terms when used herein do not imply a sequence or order unless clearly indicated by the context. Thus, a first element, component, region, layer or section discussed below could be termed a second element, component, region, layer or section without departing from the teachings of the example embodiments.

Spatially relative terms, such as "inner," "outer," "beneath," "below," "lower," "above," "upper," and the like, may be used herein for ease of description to describe one element or feature's relationship to another element(s) or feature(s) as illustrated in the figures. Spatially relative terms may be intended to encompass different orientations of the device in use or operation in addition to the orientation depicted in the figures. For example, if the device in the figures is turned over, elements described as "below" or "beneath" other elements or features would then be oriented "above" the other elements or features. Thus, the example term "below" can encompass both an orientation of above and below. The device may be otherwise oriented (rotated 90 degrees or at other orientations) and the spatially relative descriptors used herein interpreted accordingly.

With reference to the figures, a sole structure for an article of footwear having an upper is provided. The sole structure includes a first plate having a first surface facing away from the upper. The first plate includes a forefoot region at an anterior end of the first plate, a heel region at a posterior end of the first plate, and a mid-foot region intermediate the forefoot region and the heel region. The sole structure further includes a second plate having a second surface opposing the first surface of the first plate. The second plate has a first end attached at the forefoot region of the first plate, and extends to a second end that is spaced apart from the first surface of the first plate. A cushion is disposed between the first plate and the second plate in the forefoot region and has a first side attached to the first surface of the first plate and a second side attached to the second surface of second plate. The cushion extends from a medial side of the sole structure to a lateral side of the sole structure.

Implementations of the disclosure may include one of more of the following optional features. In some examples, the cushion is a fluid-filled bladder and includes a tensile member disposed therein.

In some examples, the fluid-filled bladder is pressurized. Optionally, the fluid-filled bladder is at a pressure between 15 psi and 25 psi. Alternatively, the fluid-filled bladder is at a pressure between 20 psi and 25 psi. In other examples, the fluid-filled bladder is at a pressure of 20 psi. In some examples, the fluid-filled bladder is at a pressure of 25 psi.

In some implementations, the cushion extends continuously from a medial side of the sole structure to a lateral side of the sole structure.

The sole structure may further include a toe pad disposed between the first plate and the second plate and disposed at the anterior end of the first plate. In some implementations, the first end of the second plate is attached to the toe pad. In some examples, the toe pad is formed of a foamed polymeric material. In some implementations, wherein a first surface of the toe pad is attached to the first surface of the first plate and a second surface of the toe pad is attached to the second surface of the second plate. The first surface of the toe pad and the second surface of the toe pad may diverge from each other along a direction from the anterior end of the first plate to the posterior end of the first plate. The toe pad may include a groove extending from a medial side of the sole structure to a lateral side of the sole structure. Optionally, the cushion may be spaced apart from the toe pad by a gap, the gap extending continuously from the medial side to the lateral side.

In some implementations, the first plate is formed of a composite material and the second plate is formed of a polymeric material. Here, the composite material may comprise a carbon fiber material and a binder.

In some examples, the first plate includes fiber bundles arranged on a substrate. Optionally, the first plate includes unidirectional tape.

In some implementations, the first plate is formed by an injection molding process.

In some examples, the second plate includes a third surface formed on an opposite side of the second plate than the second surface and including a plurality of traction elements protruding therefrom. Optionally, at least one of the traction elements includes a flange attached to the second plate. The flange may be attached between the second surface and the third surface of the second plate. In some examples, the flange is encapsulated in the second plate. A spike may extend from the flange and from the third surface. The spike may be removably attached to the flange. Alternatively, the spike is integrally formed with the flange.

In some examples, the second plate includes a receptacle attached to the second plate. The receptacle may be attached between the second surface and the third surface of the second plate.

Here, the receptacle may include a retention feature exposed through the third surface of the second plate. In some examples, a traction element is removably received by the retention feature. The retention feature may be a helical thread.

In some implementations, the plurality of traction elements include primary traction elements and secondary traction elements. Here, the secondary traction elements are integrally formed with the third surface of the second plate.

In some examples, the second plate includes a third surface formed on an opposite side of the second plate than the second surface and including a network of ribs protruding from the third surface. The third surface of the second plate may include a protrusion disposed within the network of ribs, the protrusion configured to receive a traction element. The protrusion and the network of ribs may cooperate to define a ground-engaging surface.

In some implementations, the second end of the second plate is cantilevered off of a posterior end of the cushion.

In some examples, the second plate is cantilevered from the anterior end of the first plate.

In some implementations, the first end of the second plate extends upwardly at the anterior end of the first plate and forms a toe cap.

In some examples, a majority of a length of the second plate is supported by the cushion, the length extending from the first end of the second plate to the second end of the second plate.

In some implementations the sole structure includes a midsole including a toe pad disposed in a toe portion of the mid-foot region and a cushion disposed in the heel region.

The sole structure may further include a shank attached to the first surface of the first plate, the shank extending from an anterior end disposed between the first plate and the cushion to a posterior end of the shank adjacent the heel region. Here, the shank includes a protuberance having an outer periphery offset inwardly from an outer periphery of the shank, an anterior end of the protuberance spaced apart from and complementary to an outer periphery of the cushion.

The sole structure may include a heel pad attached to the second surface of the first plate at the posterior end. The heel pad may include a plurality of traction elements. The traction elements of the heel pad may be arranged in alternating rows and columns.

In another aspect of the disclosure, a sole structure for an article of footwear having an upper is provided. The sole structure includes a first plate having a first surface. The first plate includes a forefoot region at an anterior end of the first plate, a heel region at a posterior end of the first plate, and a mid-foot region intermediate the forefoot region and the heel region. The sole structure further includes a second plate having a second surface opposing the first surface of the first plate. The second plate includes a first end attached to the forefoot region of the first plate and extending to a second end that is spaced apart from the first surface of the first plate. A cushion has a first side attached to the first surface of the first plate and a second side attached to the second surface of second plate. The cushion extends from a first peripheral side surface of the second plate to an opposing second peripheral side surface of the second plate.

Implementations of the disclosure may include one of more of the following optional features. In some examples, the cushion is a fluid-filled bladder and includes a tensile member disposed therein.

In some examples, the fluid-filled bladder is pressurized. Optionally, the fluid-filled bladder is at a pressure between 15 psi and 25 psi. Alternatively, the fluid-filled bladder is at a pressure between 20 psi and 25 psi. In other examples, the fluid-filled bladder is at a pressure of 20 psi. In some examples, the fluid-filled bladder is at a pressure of 25 psi.

In some implementations, the cushion extends continuously from the medial side of the sole structure to the lateral side of the sole structure.

The sole structure may further include a toe pad disposed between the first plate and the second plate and disposed at the anterior end of the first plate. In some implementations, the first end of the second plate is attached to the toe pad. In some examples, the toe pad is formed of a foamed polymeric material. In some implementations, wherein a first surface of the toe pad is attached to the first surface of the first plate and a second surface of the toe pad is attached to the second surface of the second plate. The first surface of the toe pad and the second surface of the toe pad may diverge from each other along a direction from the anterior end of the first plate to the posterior end of the first plate. The toe pad may include a groove extending from the medial side of the sole structure to the lateral side of the sole structure. Optionally, the cushion may be spaced apart from the toe pad by a gap, the gap extending continuously from the medial side to the lateral side.

In some implementations, the first plate is formed of a composite material and the second plate is formed of a polymeric material. Here, the composite material may comprise a carbon fiber material and a binder.

In some examples, the first plate includes fiber bundles arranged on a substrate. Optionally, the first plate includes unidirectional tape.

In some implementations, the first plate is formed by an injection molding process.

In some examples, the second plate includes a third surface formed on an opposite side of the second plate than the second surface and including a plurality of traction elements protruding therefrom. Optionally, at least one of the traction elements includes a flange attached to the second plate. The flange may be attached between the second surface and the third surface of the second plate. In some examples, the flange is encapsulated in the second plate. A spike may extend from the flange and from the third surface. The spike may be removably attached to the flange. Alternatively, the spike is integrally formed with the flange.

In some examples, the second plate includes a receptacle attached to the second plate. The receptacle may be attached between the second surface and the third surface of the second plate.

Here, the receptacle may include a retention feature exposed through the third surface of the second plate. In some examples, a traction element is removably received by the retention feature. The retention feature may be a helical thread.

In some implementations, the plurality of traction elements include primary traction elements and secondary traction elements. Here, the secondary traction elements are integrally formed with the third surface of the second plate.

In some examples, the second plate includes a third surface formed on an opposite side of the second plate than the second surface and including a network of ribs protruding from the third surface. The third surface of the second plate may include a protrusion disposed within the network of ribs, the protrusion configured to receive a traction element. The protrusion and the network of ribs may cooperate to define a ground-engaging surface.

In some implementations, the second end of the second plate is cantilevered off of a posterior end of the cushion.

In some examples, the second plate is cantilevered from the anterior end of the first plate.

In some implementations, the first end of the second plate extends upwardly at the anterior end of the first plate and forms a toe cap.

In some examples, a majority of a length of the second plate is supported by the cushion, the length extending from the first end of the second plate to the second end of the second plate.

In some implementations the sole structure includes a midsole including a toe pad disposed in a toe portion of the mid-foot region and a cushion disposed in the heel region.

The sole structure may further include a shank attached to the first surface of the first plate, the shank extending from an anterior end disposed between the first plate and the cushion to a posterior end of the shank adjacent the heel region. Here, the shank includes a protuberance having an outer periphery offset inwardly from an outer periphery of the shank, an anterior end of the protuberance spaced apart from and complementary to an outer periphery of the cushion.

The sole structure may include a heel pad attached to the second surface of the first plate at the posterior end. The heel pad may include a plurality of traction elements. The traction elements of the heel pad may be arranged in alternating rows and columns.

Referring to FIGS. 1-10, an article of footwear 10 includes an upper 100 and sole structure 200. The article of footwear 10 may be divided into one or more regions. The regions may include a forefoot region 12, a mid-foot region 14, and a heel region 16. The forefoot region 12 may be subdivided into a toe portion 12T corresponding with phalanges, and a ball portion 12B associated with metatarsal bones of a foot. The mid-foot region 14 may correspond with an arch area of the foot, and the heel region 16 may correspond with rear portions of the foot, including a calcaneus bone. The footwear 10 may further include an anterior end 18 associated with a forward-most point of the forefoot region 12, and a posterior end 20 corresponding to a rearward-most point of the heel region 16. As shown in FIG. 6B, a longitudinal axis $A_F$ of the footwear 10 extends along a length of the footwear 10 from the anterior end 18 to the posterior end 20, and generally divides the footwear 10 into a medial side 22 and a lateral side 24. Accordingly, the medial side 22 and the lateral side 24 respectively correspond with opposite sides of the footwear 10 and extend through the regions 12, 14, 16.

The upper 100 includes interior surfaces that define an interior void 102 configured to receive and secure a foot for support on sole structure 200. The upper 100 may be formed from one or more materials that are stitched or adhesively bonded together to form the interior void 102. Suitable materials of the upper may include, but are not limited to, mesh, textiles, foam, leather, and synthetic leather. The materials may be selected and located to impart properties of durability, air-permeability, wear-resistance, flexibility, and comfort.

In some examples, one or more fasteners 110 extend along the upper 100 to adjust a fit of the interior void 102 around the foot and to accommodate entry and removal of the foot therefrom. The upper 100 may include apertures 112 such as eyelets and/or other engagement features such as fabric or mesh loops that receive the fasteners 110. The fasteners 110 may include laces, straps, cords, hook-and-loop, or any other suitable type of fastener. The upper 100 may include a tongue portion 114 that extends between the interior void 102 and the fasteners.

Figure 8:
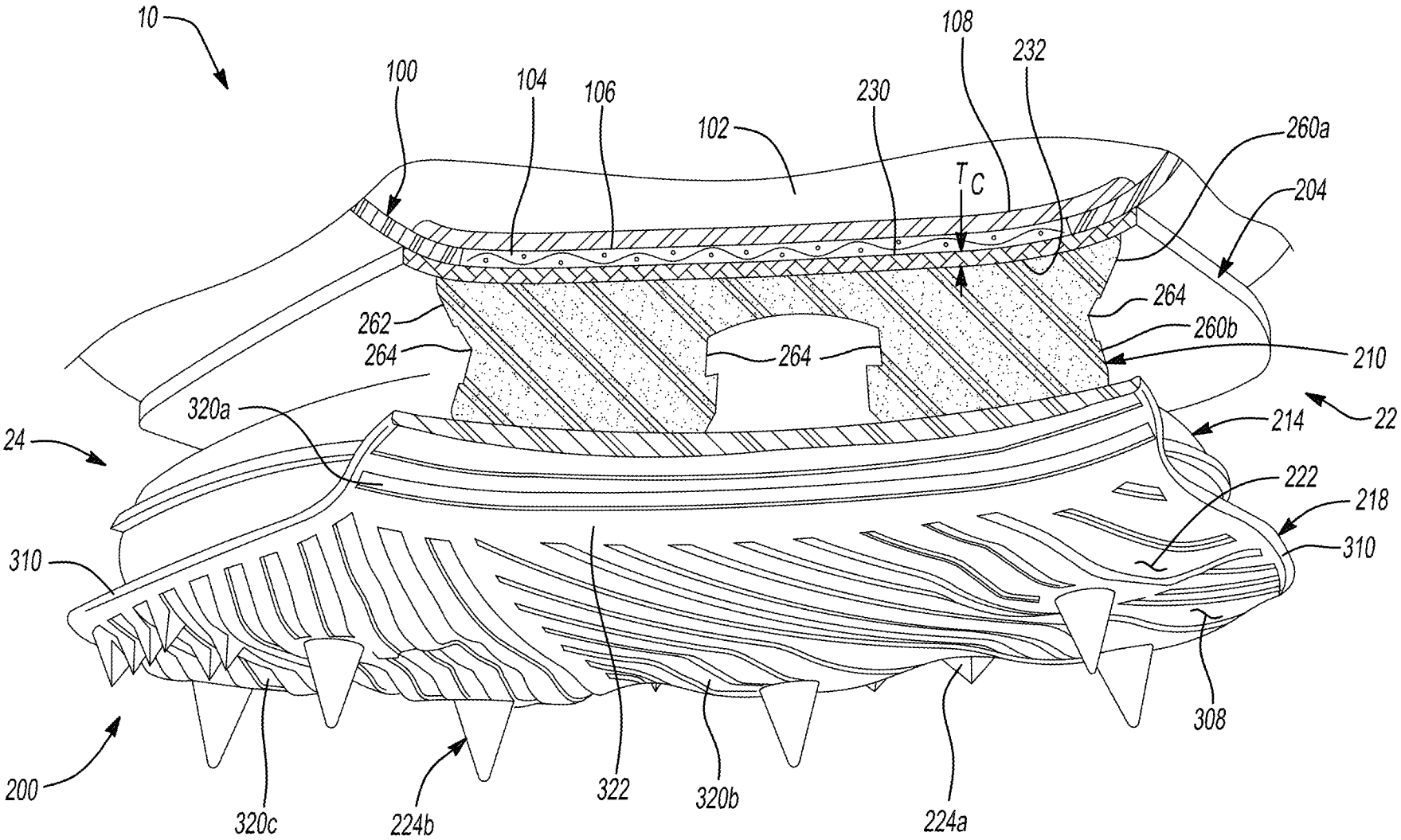
FIG. 8 is a cross-sectional view of the article of footwear of FIG. 1 taken along Line 8-8 of FIG. 6B.
Figure 9:
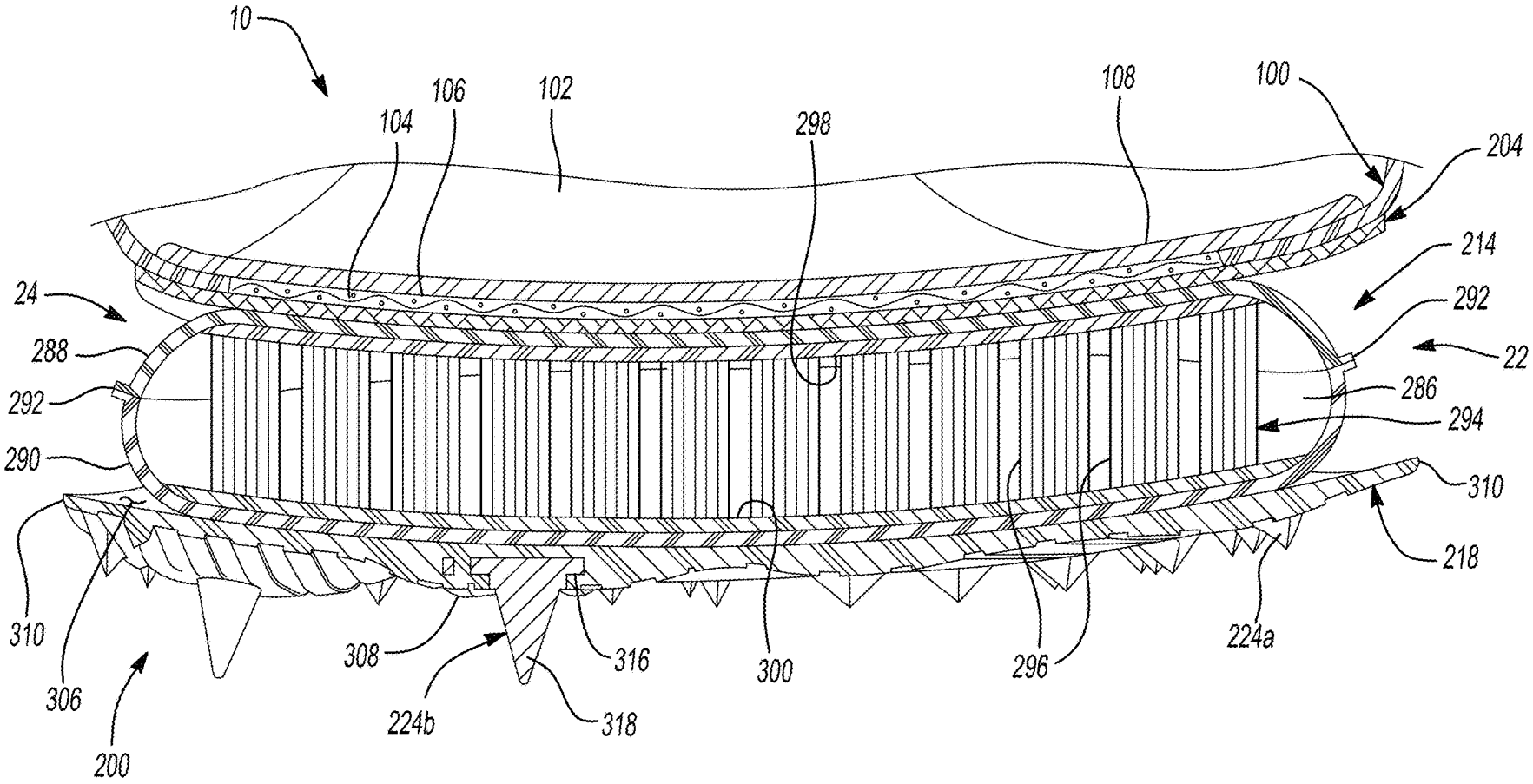
FIG. 9 is a cross-sectional view of the article of footwear of FIG. 1 taken along Line 9-9 of FIG. 6B.
Figure 10:
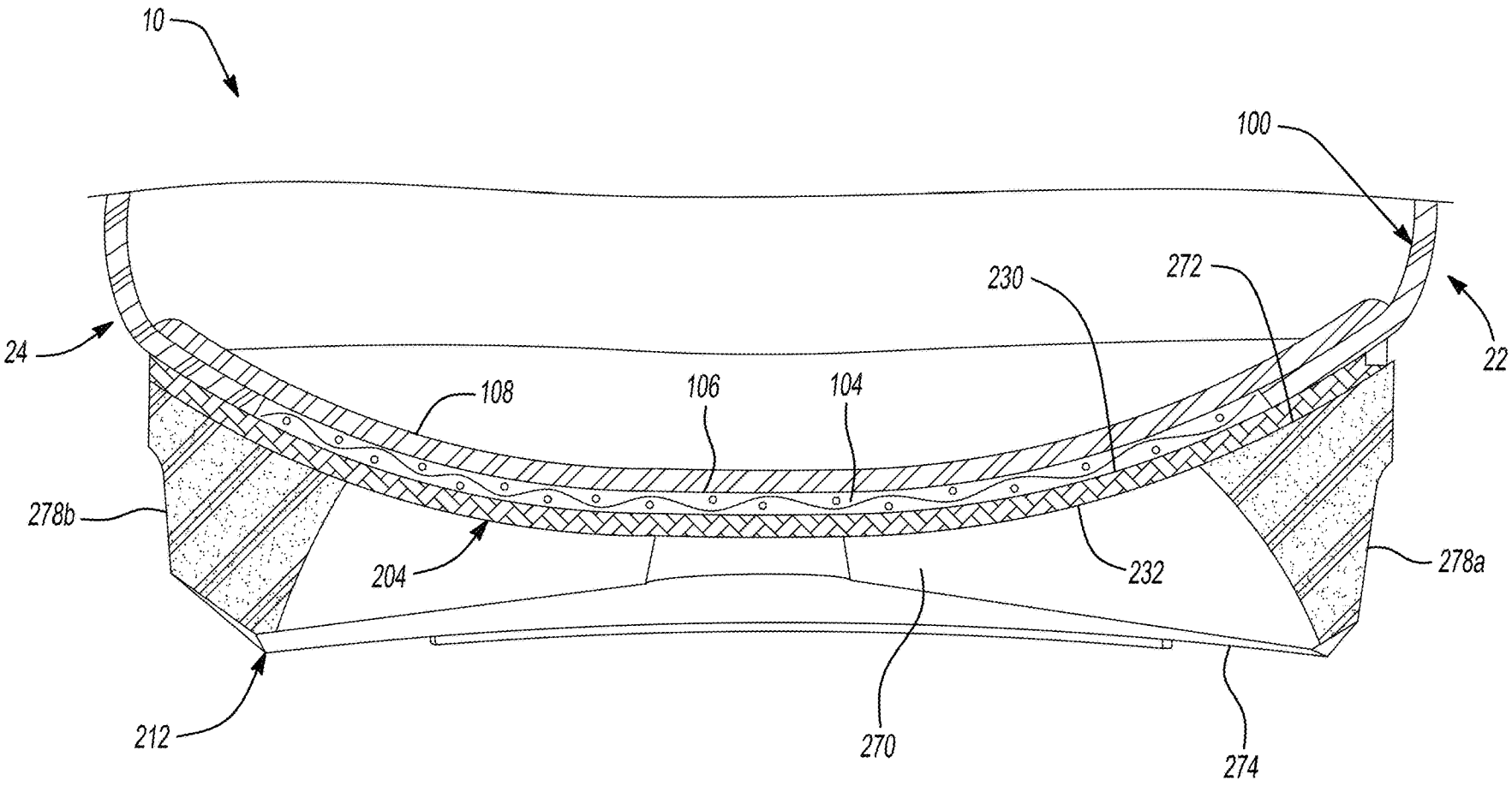
FIG. 10 is a cross-sectional view of the article of footwear of FIG. 1 taken along Line 10-10 of FIG. 6B.
Figure 11:
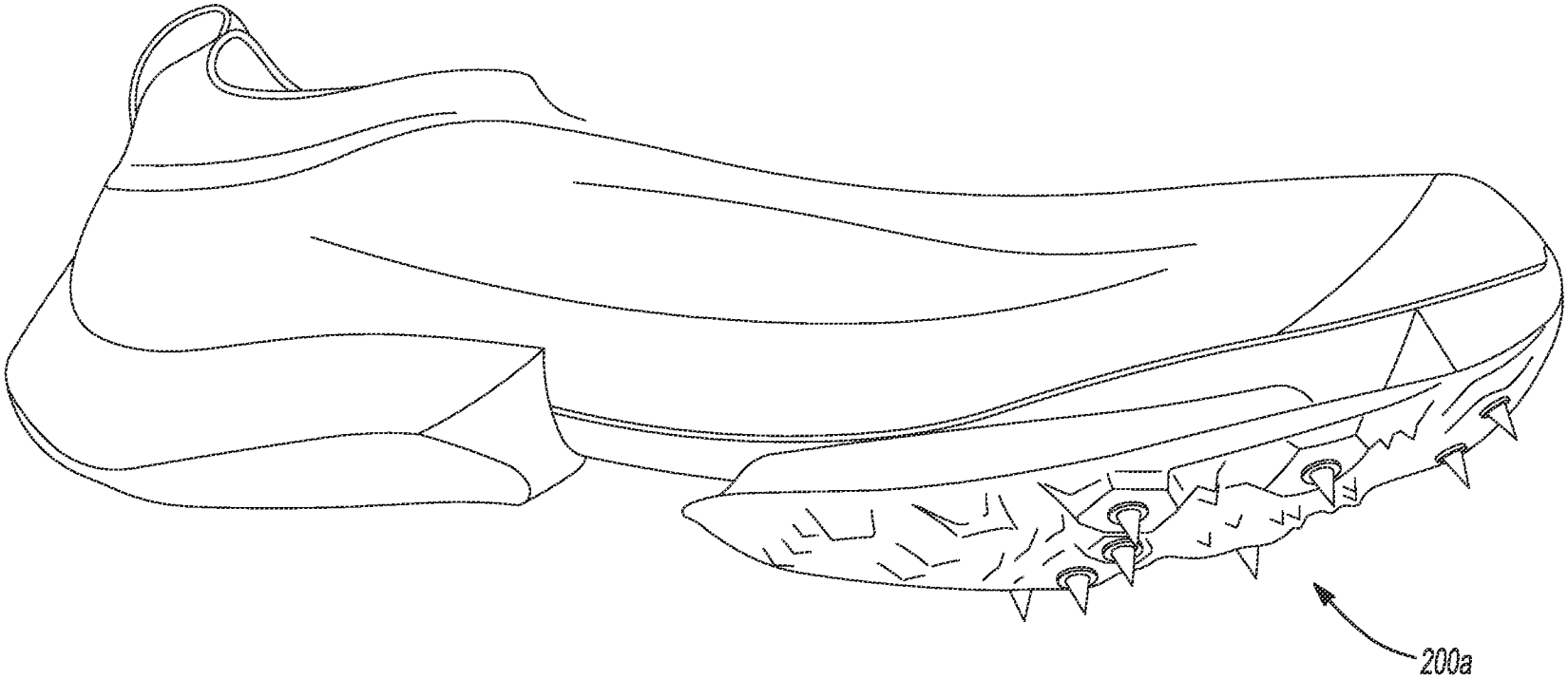
FIG. 11 is a medial side elevation view of an article of footwear incorporating a sole structure in accordance with the principles of the present disclosure.
Figure 12:
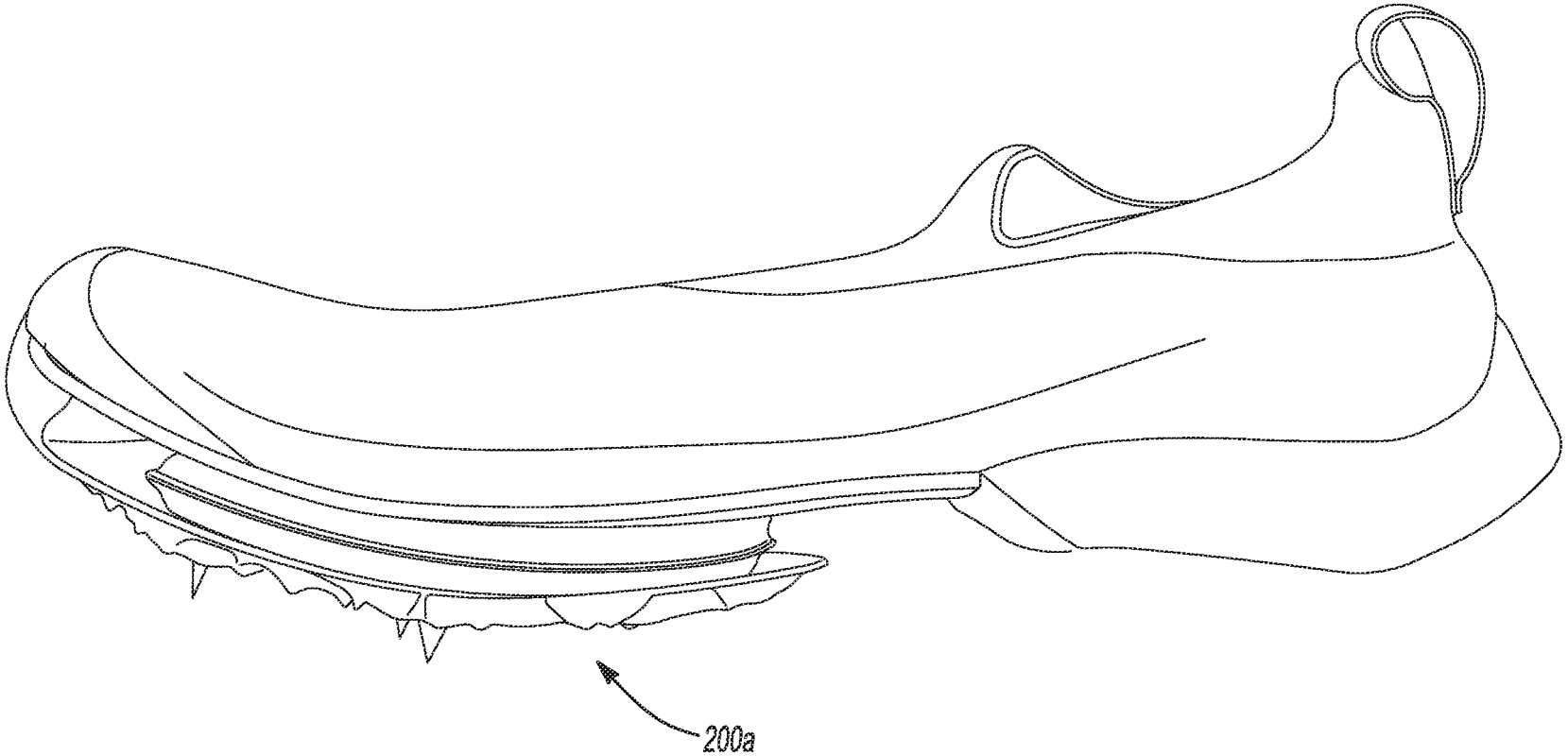
FIG. 12 is a lateral side elevation view of the article of footwear of FIG. 11.

With reference to FIGS. 8 and 9, in some examples the upper 100 includes a strobel 104 having a bottom surface opposing the sole structure 200 and an opposing top surface defining a footbed 106 of the interior void 102. Stitching or adhesives may secure the strobel to the upper 100. The footbed 106 may be contoured to conform to a profile of the bottom surface (e.g., plantar) of the foot. Optionally, the upper 100 may also incorporate additional layers such as an insole 108 or sockliner that may be disposed upon the strobel 104 and reside within the interior void 102 of the upper 100 to receive a plantar surface of the foot to enhance the comfort of the article of footwear 10. An ankle opening 116 in the heel region 16 may provide access to the interior void 102. For example, the ankle opening 116 may receive a foot to secure the foot within the void 102 and to facilitate entry and removal of the foot from and to the interior void 102.

Figure 2:
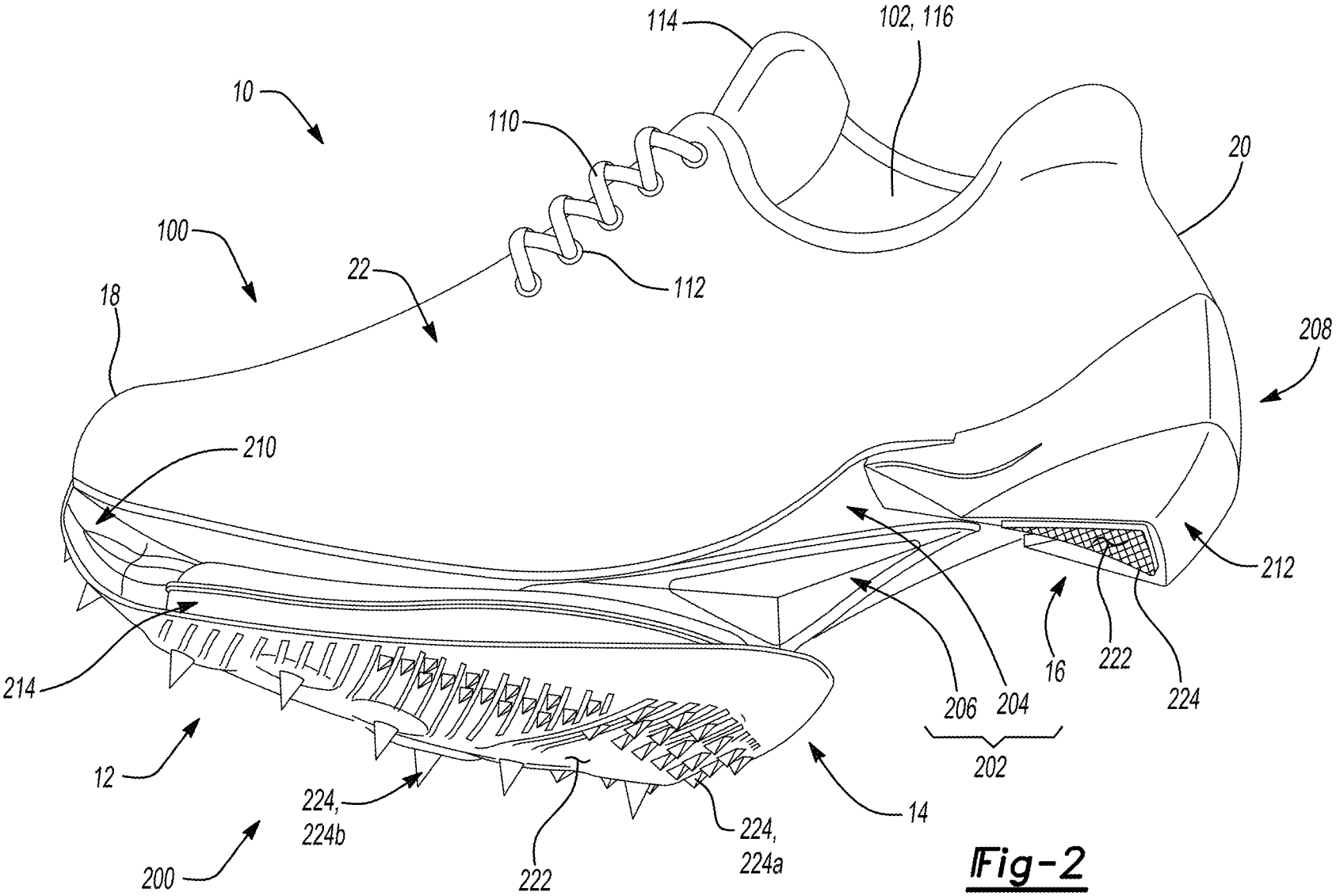
FIG. 2 is a perspective view of an article of footwear incorporating a sole structure in accordance with the principles of the present disclosure.
Figure 3:
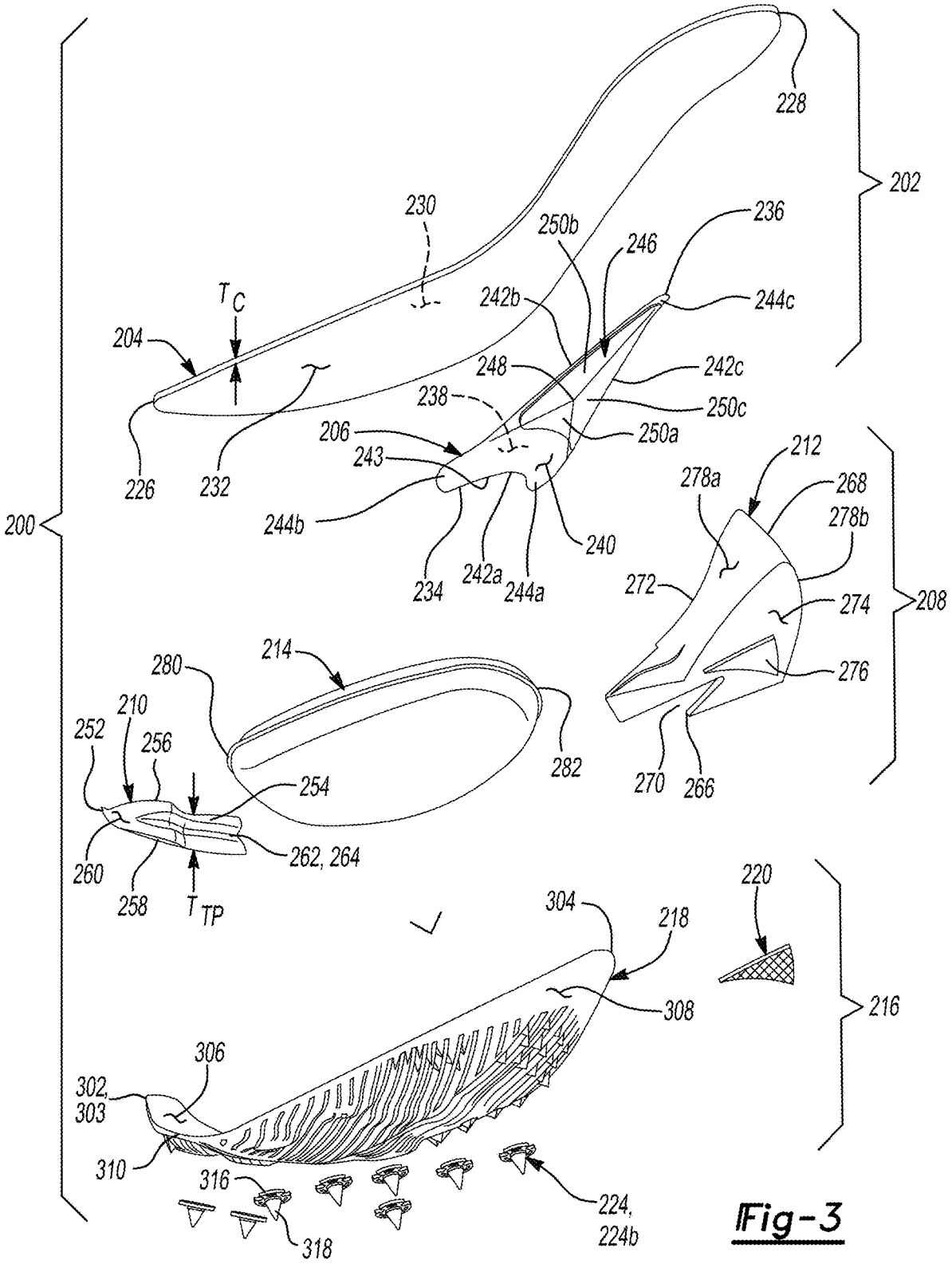
FIG. 3 is an exploded view of the sole structure of the article of footwear of FIG. 1.

With reference to FIGS. 1-3, the sole structure 200 includes a chassis 202 having a chassis plate 204 extending between the medial side 22 and the lateral side 24 from the anterior end 18 to the posterior end 20. A shank 206 is attached to the plate 204 and extends from the mid-foot region 14 to the heel region 16. The sole structure 200 further includes a midsole 208 attached to the chassis 202 and including an toe pad 210 disposed adjacent the anterior end 18 of the chassis 202, a heel pad 212 disposed adjacent the posterior end 20 of the chassis 202, and a cushion 214 disposed in the forefoot region 12 of the chassis 202. The sole structure 200 further includes an outsole 216 having a forefoot plate 218 attached to each of the toe pad 210 and the cushion 214, and a heel plate 220 attached to the heel pad 212. The forefoot plate 218 and the heel plate 220 cooperate to define a ground-engaging surface 222 of the sole structure 200. A plurality of traction elements 224, 224*a*, 224*b* may extend from the outsole 216, and form part of the ground-engaging surface 222.

With reference to FIGS. 3 and 7-10, the chassis plate 204 extends from a first end 226 at the anterior end 18 of the sole structure 200 to a second end 228 at the posterior end 20, and spans a width of the sole structure 200 from the medial side 22 to the lateral side 24. Accordingly, an upper surface 230 of the chassis 202 defines a profile of the footbed 106 of the upper 100. The chassis plate 204 further includes a lower surface 232 formed opposite the upper surface 230. A distance between the upper surface 230 and the lower surface 232 defines a thickness $T_C$ of the chassis plate 204.

The chassis plate 204 may be manufactured using fiber sheets or textiles, including pre-impregnated (i.e., "prepreg") fiber sheets or textiles. Alternatively or additionally, the chassis plate 204 may be manufactured by strands formed from multiple filaments of one or more types of fiber (e.g., fiber tows) by affixing the fiber tows to a substrate or to each other to produce a plate having the strands of fibers arranged predominately at predetermined angles or in predetermined positions. When using strands of fibers, the types of fibers included in the strand can include synthetic polymer fibers which can be melted and re-solidified to consolidate the other fibers present in the strand and, optionally, other components such as stitching thread or a substrate or both. Alternatively or additionally, the fibers of the strand and, optionally the other components such as stitching thread or a substrate or both, can be consolidated by applying a resin after affixing the strands of fibers to the substrate and/or to each other. The above processes are described below.

In some configurations, chassis plate 204 may be formed from one or more layers of tows of fibers and/or layers of fibers including at least one of carbon fibers, boron fibers, glass fibers, and polymeric fibers. In a particular configuration, the fibers include carbon fibers, or glass fibers, or a combination of both carbon fibers and glass fibers. The tows of fibers may be affixed to a substrate. The tows of fibers may be affixed by stitching or using an adhesive. Additionally or alternatively, the tows of fibers and/or layers of fibers may be consolidated with a thermoset polymer and/or a thermoplastic polymer. Accordingly, the chassis plate 204 may have a tensile strength or flexural strength in a transverse direction substantially perpendicular to the longitudinal axis $A_L$. The stiffness of the chassis plate 204 may be selected for a particular wearer based on the wearer's tendon flexibility, calf muscle strength, and/or metatarsophalangeal (MTP) joint flexibility. Moreover, the stiffness of the chassis plate 204 may also be tailored based upon a running motion of the athlete. In other configurations, the chassis plate 204 is formed from one or more layers/plies of unidirectional tape. In some examples, each layer in the stack includes a different orientation than the layer disposed underneath. The plate may be formed from unidirectional tape including at least one of carbon fibers, boron fibers, glass fibers, and polymeric fibers. In some examples, the one or more materials forming the chassis plate 204 include a Young's modulus of at least 70 gigapascals (GPa).

In some implementations, the chassis plate 204 includes a substantially uniform thickness $T_C$. In some examples, the thickness of the chassis plate 204 ranges from about 0.6 millimeter (mm) to about 3.0 mm. In one example, the thickness of the chassis plate 204 is substantially equal to one 1.0 mm. In other implementations, the thickness $T_C$ of the chassis plate 204 is non-uniform such that the chassis plate 204 may have a greater thickness $T_C$ in the mid-foot region 14 of the sole structure 200 than the thicknesses $T_C$ in the forefoot region 12 and the heel region 16.

With continued reference to FIGS. 1-7, the shank 206 of the chassis 202 is attached to the lower surface 232 of the chassis plate 204 and extends from a first end 234 in the mid-foot region 14 to a second end 236 in the heel region 16. An upper surface 238 of the shank 206 is attached to the lower surface 232 of the chassis plate 204. The shank 206 includes a peripheral side surface 242 extending between the upper surface 238 and the lower surface 240.

With reference to FIG. 3, the peripheral side surface 242 of the shank 206 includes a plurality of side surfaces 242*a*-242*c* defining an outer periphery of the shank 206. For example, the side surfaces 242 include an anterior-facing, front surface 242*a*, a medial side surface 242*b*, and a lateral side surface 242*c*. The front surface 242*a* extends along the first end 234 of the shank 206 between the medial side 22 and the lateral side 24. The front surface 242*a* may be arcuate and define a concave recess 243 formed through the first end 234 of the shank 206. As discussed below, the recess 243 complements to a peripheral profile of the cushion 214, and is configured to receive a portion of the cushion 214 therethrough to allow the cushion 214 to be attached directly to the chassis plate 204.

The medial and lateral side surfaces 242*b*, 242*c* extend, generally, from opposing ends of the front surface 242*a* and converge with each other at the second end 236 of the shank 206. Accordingly, a width of the shank 206 may taper from the first end 234 to the second end 236, such that the width of the shank is greater at the first end 234 than at the second end 236. Respective intersections between each of the side surfaces 242*a*-242*c* may be convex, and form convex tips 244, 244*a*-244*c* of the shank 206.

The shank 206 may further include a boss 246 protruding from the lower surface 240. The boss 246 provides a stepped increase in a thickness of a central portion of the shank 206. The boss 246 has an outer periphery that is offset inwardly from the outer periphery of the shank 206. A thickness of the boss 246, and consequentially—the shank 206—may taper from a first thickness at a central vertex 248 to lesser thicknesses at the outer periphery of the shank 206. As shown, the vertex 248 is formed by the convergence of three boss surfaces 250, 250-250*c*, each extending inwardly from the respective side surfaces 242, 242*a*-242*c*.

The shank 206 is formed of a rigid polymeric material and may be attached to the lower surface 232 of the chassis plate 204 using an adhesive. Alternatively, the shank 206 may be integrally molded with the chassis plate 204, such that at least a portion of the shank 206 is encapsulated within the resin of the chassis plate 204. Additionally or alternatively, the shank 206 may be attached to the chassis plate 204 by melding a material of the shank 206 to a material of the chassis plate 204.

With reference to FIGS. 1-5, the midsole 208 is disposed between the chassis 202 and the outsole 216, and is configured to attenuate forces associated with impact of the sole structure 200 with a ground surface. As shown in FIG. 3, the midsole 208 includes the toe pad 210, the heel pad 212, and the cushion 214.

Figure 5:
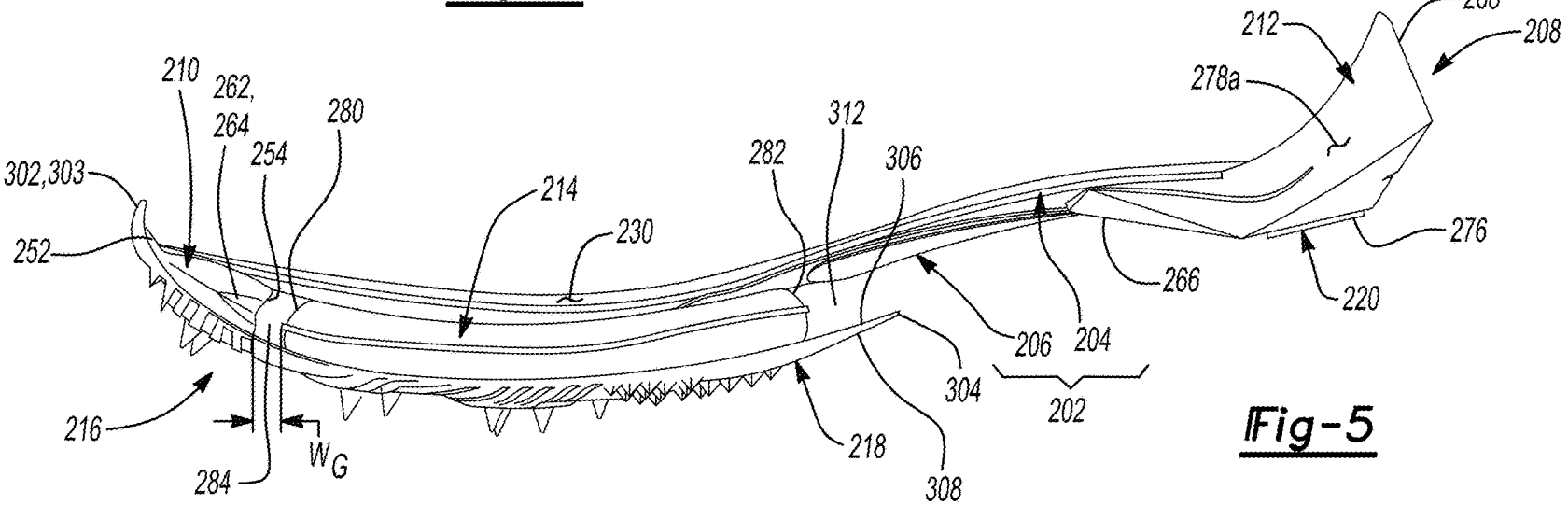
FIG. 5 is a medial side elevation view of the sole structure of the article of footwear of FIG. 1.
Figure 6B:
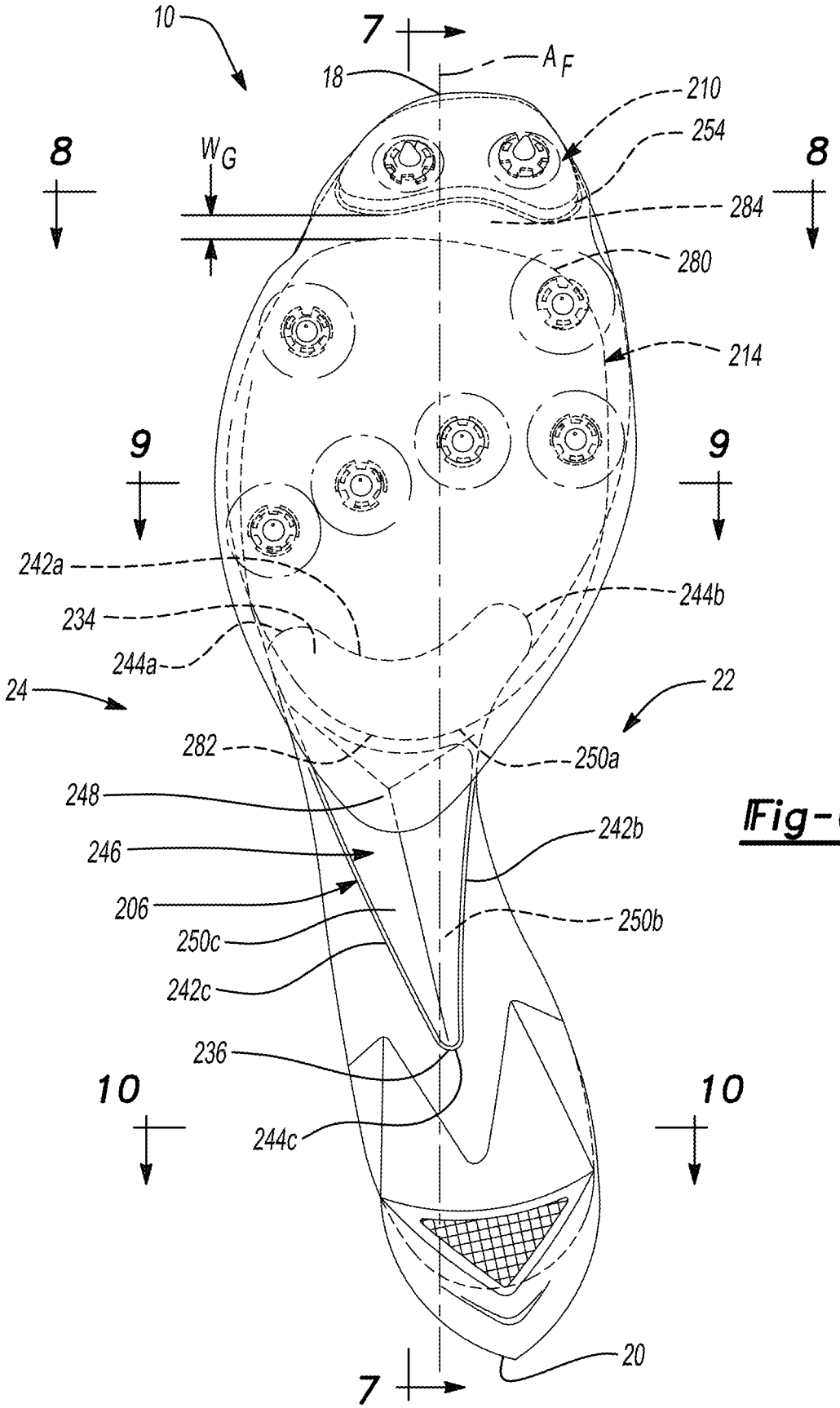
FIG. 6B is a bottom plan view of the sole structure of the article of footwear of FIG. 1, where details of the sole structure have been hidden for clarity.
Figure 7:
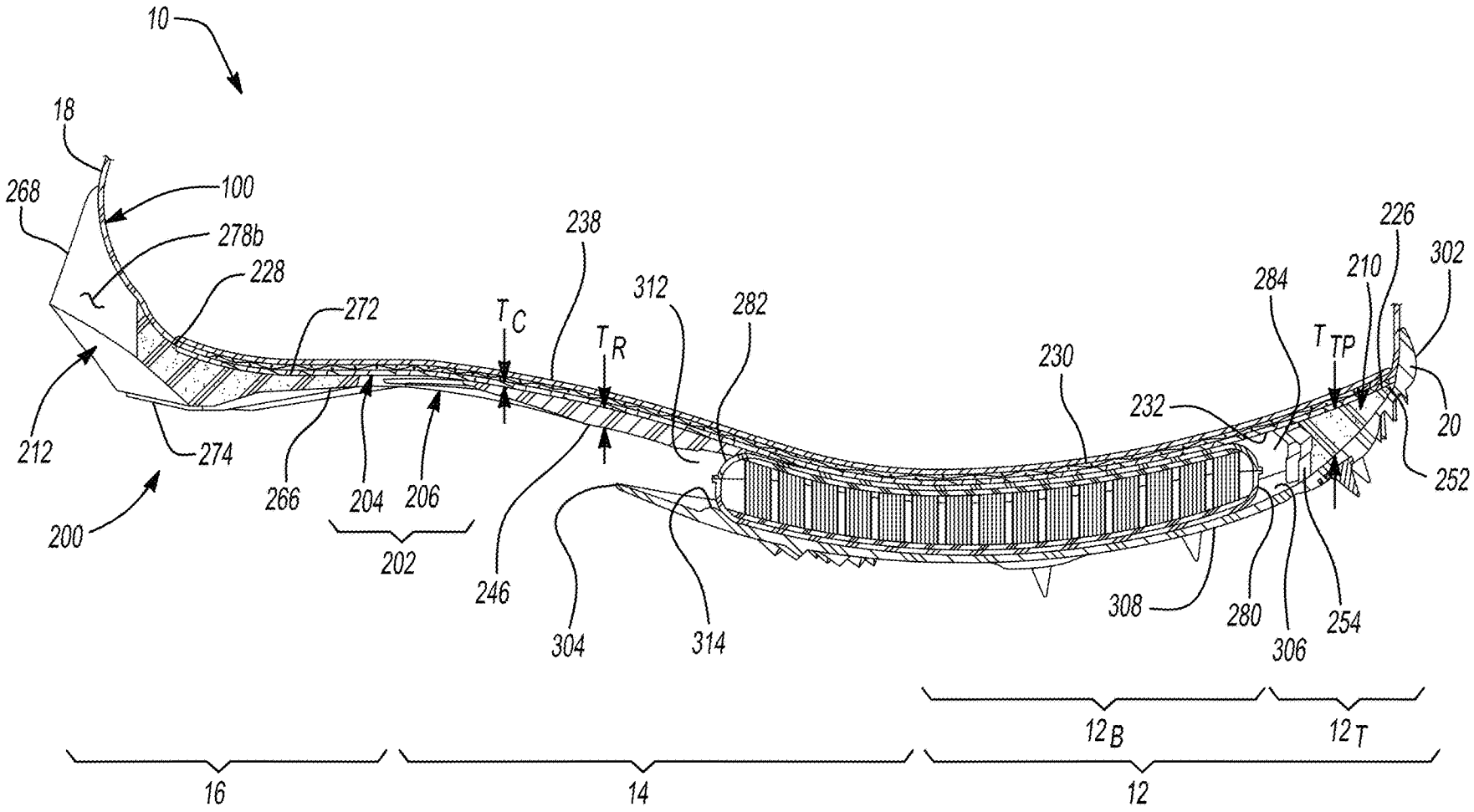
FIG. 7 is a cross-sectional view of the article of footwear of FIG. 1 taken along Line 7-7 of FIG. 6B.

With reference to FIGS. 3, 5, and 7, the toe pad 210 extends from a first end 252 at the anterior end 18 of the sole structure 200 to a second end 254 within the forefoot region 12. In the illustrated embodiment, the toe pad 210 is disposed within the toe portion 12T of the forefoot region 12. An upper surface 256 of the toe pad 210 is attached to the lower surface 232 of the chassis plate 204. The toe pad 210 further includes a lower surface 258 formed opposite the upper surface 256, and a peripheral side surface 260 extending between the lower surface 258 and the upper surface 256. A distance between the upper surface 256 and the distal side surface defines a thickness $T_{TP}$ of the toe pad 210. As shown in FIG. 7, the upper surface 256 and the lower surface 258 diverge from each other in a direction from the first end 252 to the second end 254. Accordingly, the thickness $T_{TP}$ of the toe pad 210 increases continuously from the first end 252 to the second end 254, such that the toe pad forms a wedge between the chassis plate 204 and the forefoot plate 218 of the outsole 216 in the toe portion 12T. As illustrated in FIGS. 3 and 6B, the second end 254 of the toe pad 210 may be contoured, and extend along an arcuate or concave path between the medial side 22 and the lateral side 24.

Additionally, as shown in FIGS. 3-5 and 8, the peripheral side surface 260 may define a groove 262 extending from the medial side 22 to the lateral side 24 along the second end 254 of the toe pad 210. For example, as indicated in FIG. 8, the peripheral side surface 260 may include an upper peripheral side surface 260*a* extending inwardly from an outer periphery of the upper surface 256 at a first angle, and a lower peripheral side surface 260*b* extending inwardly from an outer periphery of the lower surface 258 at a second angle. Accordingly, the upper peripheral side surface 260*a* and the lower peripheral side surface 260*b* converge with each other to define a V-shaped groove 262 between the upper surface 256 and the lower surface 258. As shown, a height of the groove may taper along each of the medial side 22 and the lateral side 24.

With reference to FIGS. 7 and 8, the groove 262 may include a channel 264 formed along a length thereof, where the upper peripheral side surface 260*a* and the lower peripheral side surface 260*b* converge. As shown in FIG. 8, the channel 264 is inwardly offset from the respective peripheral side surfaces 260*a*, 260*b*. As described in greater detail below, the toe pad 210 may function as a fulcrum for the forefoot plate 218, such that the forefoot plate 218 is cantilevered along the forefoot region 12. Accordingly, the groove 262 and the channel 264 of the peripheral side surface 260 cooperate to allow the respective outer peripheries of the upper surface 256 and the lower surface 258 to bend relative to each other.

Figure 6A:
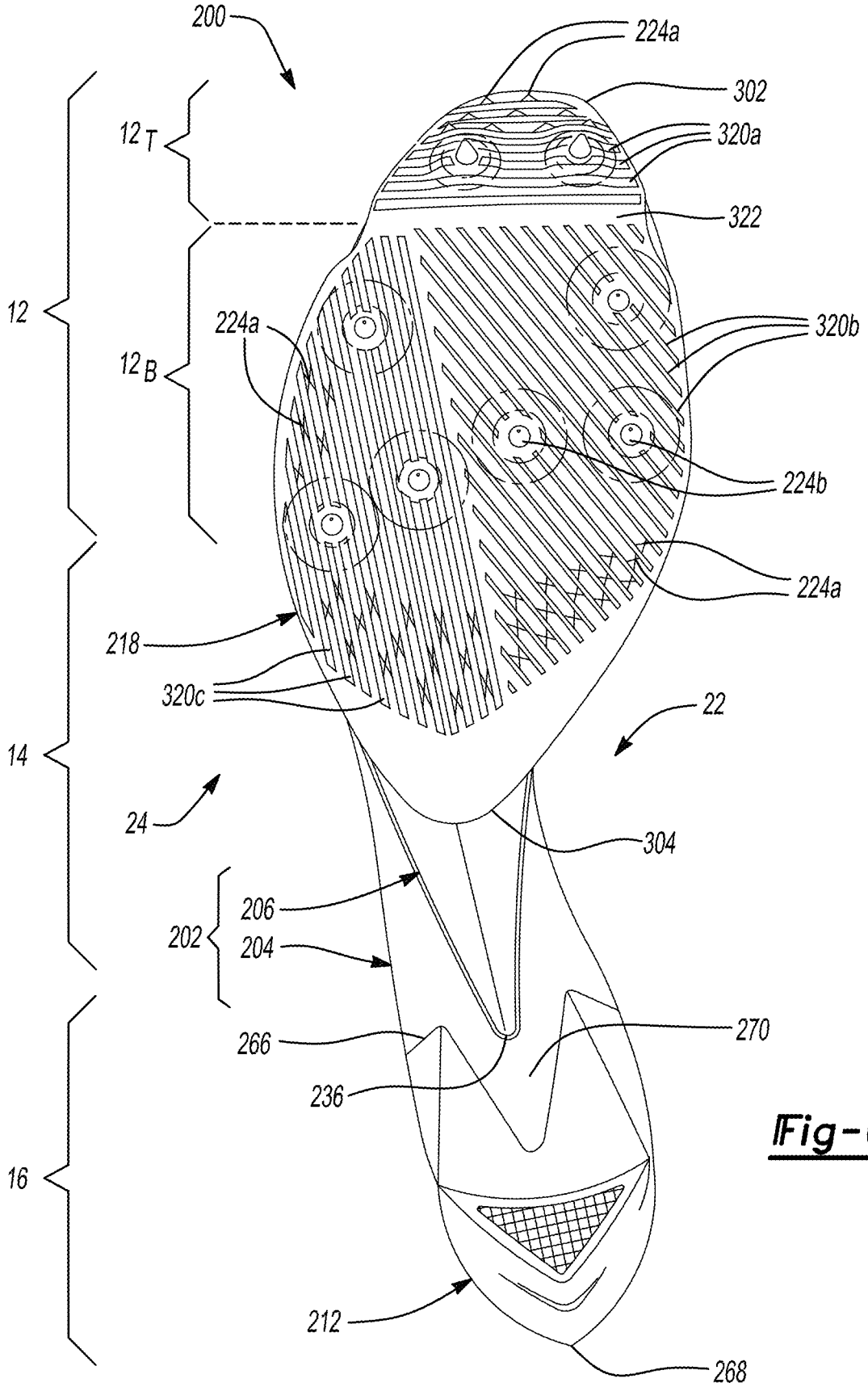
FIG. 6A is a bottom plan view of the sole structure of the article of footwear of FIG. 1.

Referring to FIGS. 3-6A, the heel pad 212 is attached to the lower surface 232 of the chassis plate 204 and extends from a first end 266 adjacent the mid-foot region 14 to a second end 268 at the anterior end 18 of the sole structure 200. The first end 266 of the heel pad 212 may include a V-shaped notch 270 configured to receive the second end 236 of the shank 206, as shown in FIG. 6A. Accordingly, a profile of the notch 270 may be offset from a profile of the medial and lateral side surfaces 242*b*, 242*c* of the shank 206.

The heel pad 212 includes an upper surface 272 attached to the lower surface 232 of the chassis plate 204, and a lower surface 274 formed opposite the upper surface 272. The lower surface 274 may include a surface feature 276 configured to engage the heel plate 220. For example, the illustrated heel pad 212 includes a triangular boss 276 extending from the lower surface 274. In other examples, the surface feature may be a plurality of bosses or recesses, and may have any shape for cooperating with the heel plate 220.

The heel pad 212 further includes a peripheral side surface 278 extending between the upper surface 272 and the lower surface 274. The peripheral side surface 278 may include a medial side surface 278*a* and a lateral side surface 278*b* that converge with each other at the second end 268, such that the posterior end 20 of the sole structure 200 is streamlined. In some examples, the upper surface 272 may be convex and curve upwardly towards the peripheral side surface 278 to define a heel cup around the anterior end 18 of the upper 100, as shown in FIGS. 1 and 2.

Each of the toe pad 210 and the heel pad 212 may be formed from an energy absorbing material such as, for example, polymer foam. Forming the pads 210, 212 from an energy-absorbing material such as polymer foam allows the sole structure 200 to attenuate ground-reaction forces caused by movement of the article of footwear 10 over ground during use.

Figure 4:
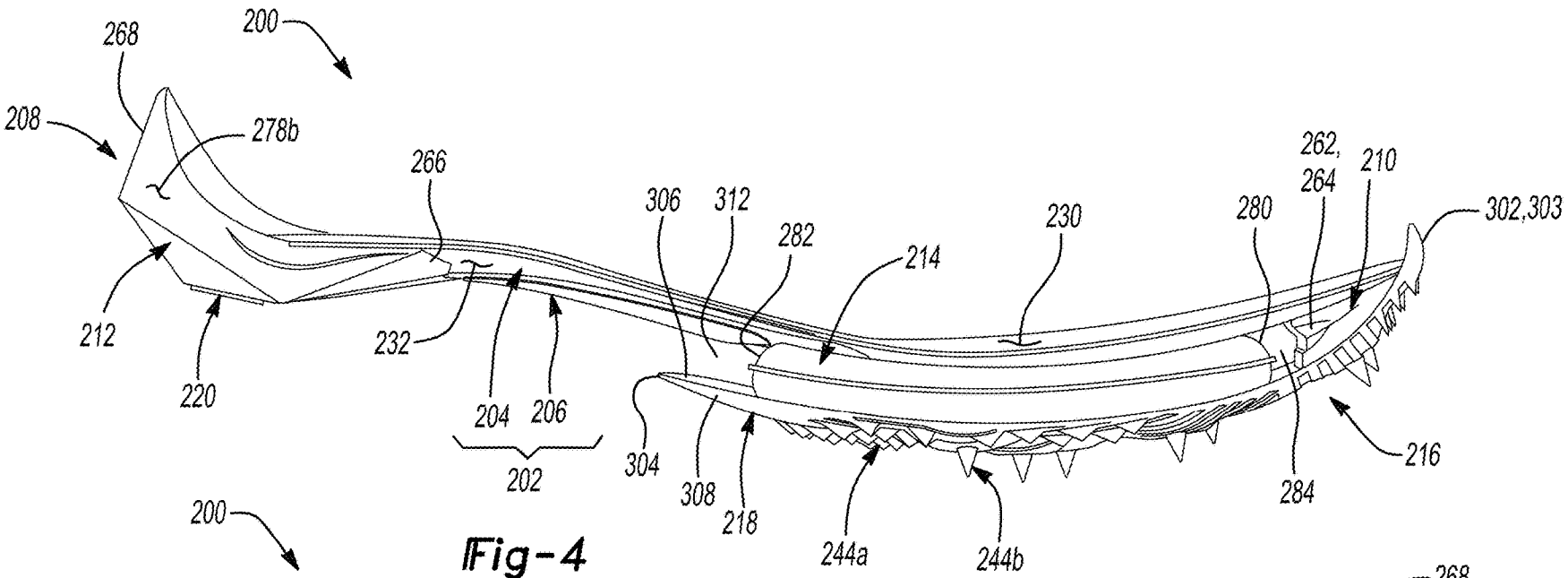
FIG. 4 is a lateral side elevation view of the sole structure of the article of footwear of FIG. 1.

With reference to FIGS. 4, 5, and 7, the cushion 214 is disposed between the chassis plate 204 and the forefoot plate 218 of the outsole 216. The cushion 214 is attached to the chassis plate 204 between the toe pad 210 and the heel pad 212, and extends from a first end 280 in the forefoot region 12 to a second end 282 in mid-foot region 14. The first end 280 of the cushion 214 opposes the second end 254 of the toe pad 210, and is spaced apart from the second end 254 by a gap 284, as shown in FIGS. 4, 5, and 6B. As discussed above and shown in FIG. 6B, the second end 254 of the toe pad 210 may have an arcuate profile, such that a width $W_G$ of the gap 284 is variable along the direction from the medial side 22 to the lateral side 24.

As described above, the cushion 214 is received between the chassis plate 204 and the forefoot plate 218. In one configuration, the cushion 214 extends continuously from the medial side 22 to the lateral side 24 of the sole structure. For example, as shown in FIG. 9, the cushion 214 extends from a first peripheral edge 310 of the forefoot plate 218 at the medial side 22 to a second peripheral edge 310 of the forefoot plate 218 at the lateral side 24. Accordingly, the chamber 286 of the cushion 214 is continuous and uninterrupted between the medial side 22 and the lateral side 24.

With reference to FIG. 6B, the first end 234 of the shank 206 may be disposed between the second end 282 of the cushion 214 and the chassis plate 204, such that the second end 282 of the cushion 214 may be attached to the first end 234 of the shank 206. As discussed above, the first end 234 of the shank 206 may be concave and include the recess 243 for allowing a portion of the cushion to be attached directly to the lower surface 232 of the chassis plate 204. While the first end 234 of the shank 206 extends between the cushion 214 and the chassis plate 204, a first end of the boss 246 is offset outwardly from an outer periphery of the cushion 214. Accordingly, the first end of the boss 246 is spaced apart from and has a profile that is complementary to a peripheral profile of the second end 282 of the cushion 214, as shown in FIG. 6B.

With particular reference to FIG. 9, the cushion 214 of the illustrated example is a fluid-filled bladder 214 defining a chamber 286 for including a pressurized fluid. The cushion 214 may include a first barrier element 288 and a second barrier element 290. The first barrier element 288 and the second barrier element 290 may be formed from a sheet of thermoplastic polyurethane (TPU). Specifically, the first barrier element 288 may be formed from a sheet of TPU material and may include a substantially planar shape. The second barrier element 290 may likewise be formed from a sheet of TPU material and may be formed into the configuration shown in FIGS. 7 and 9 to define the chamber 286. The first barrier element 288 may be attached to the second barrier element 290 by applying heat and pressure at a perimeter of the first barrier element 288 and the second barrier element 290 to define a peripheral seam 292. The peripheral seam 292 seals the chamber 286 and defines the peripheral profile of the cushion 214.

The chamber 286 of the cushion 214 may receive a tensile element 294 therein. Each tensile element 294 may include a series of tensile strands 296 extending between an upper tensile sheet 298 and a lower tensile sheet 300. The upper tensile sheet 298 may be attached to the first barrier element 288 while the lower tensile sheet 300 may be attached to the second barrier element 290. In this manner, when the chamber 286 receives the pressurized fluid, the tensile strands 296 of the tensile element 294 are placed in tension. Because the upper tensile sheet 298 is attached to the first barrier element 288 and the lower tensile sheet 300 is attached to the second barrier element 290, the tensile strands 296 retain a desired shape of the cushion 214 when the pressurized fluid is injected into the chamber 286.

In some examples, the chamber 286 is at a pressure ranging from 15 psi (pounds per square inch) to 25 psi. In other examples, the chamber 286 may have a pressure ranging from 20 psi to 25 psi. In some examples, the chamber 286 has a pressure of 20 psi. In other examples, the chamber has a pressure of 25 psi.

While the cushion 214 is described and shown as including a continuous fluid-filled chamber 286, the cushion 214 could alternatively include other cushioning elements. For example, the cushion may include a foam block that replaces or supplements the pressurized fluid. The foam block(s) may be received within the chamber 286 defined by the first barrier element 288 and the second barrier element 290. Positioning the foam block(s) within the chamber 286 defined by the first barrier element 288 and the second barrier element 290 allows the barrier elements 288, 290 to restrict expansion of the foam blocks beyond a predetermined amount when subjected to a predetermined load. Accordingly, the overall shape and, thus, the performance of the foam blocks may be controlled by allowing the foam blocks to interact with the barrier elements 288, 290 during loading. While the foam blocks are described as being received within the chamber 286 of the barrier elements 288, 290, the foam blocks could alternatively be positioned between the chassis plate 204 and the forefoot plate 218 absent the barrier elements 288, 290. In such a configuration, the foam blocks would be directly attached to the lower surface 232 of the chassis plate 204 and to forefoot plate 218, respectively.

As provided above, the outsole 216 includes the forefoot plate 218 and the heel plate 220, which cooperate to define the ground-engaging surface 222 of the sole structure 200. One or both of the forefoot plate 218 and the heel plate 220 may include traction elements 224 forming at least a portion of the ground-engaging surface 222.

With reference to FIGS. 3-5, the forefoot plate 218 includes a first end 302 attached to the lower surface 258 of the toe pad 210. In some examples, the first end 302 of the forefoot plate 218 extends upwardly along the anterior end 18 of the footwear 10, and forms a toe cap 303. The toe cap 303 may extend over the anterior end 18 of the upper 100. The forefoot plate 218 extends from the first end 302 to distal second end 304, tapering in direction, within the mid-foot region 14 of the sole structure 200. The forefoot plate 218 further includes an upper surface 306, an opposing lower surface 308, and the peripheral side surface 310 extending between the upper surface 306 and the lower surface 308.

With reference to FIGS. 4, 5, and 7, the upper surface 306 is spaced apart from the lower surface 232 of the chassis plate 204, and defines a cavity 312 between the chassis plate 204 and the forefoot plate 218 for receiving the cushion 214. As provided above, the first end 302 of the forefoot plate 218 is attached to the toe pad 210, while the remainder of the forefoot plate 218 is separated from the chassis plate 204 by the cavity 312. Accordingly, the forefoot plate 218 is cantilevered with respect to the chassis plate 204, such that the second end 304 is able to bend relative to the first end 302.

As discussed above, the cushion 214 is disposed within the cavity 312, and is attached to the lower surface 232 of the chassis plate 204 on a first side, and to the upper surface 306 of the forefoot plate on a second side. Accordingly, flex of the forefoot plate 218 may be attenuated by the cushion 214. Referring to FIG. 7, the first end 280 of the cushion 214 is spaced apart from the toe pad 210 by the gap 284, while the second end 282 of the cushion 214 is offset inwardly from the second end 304 of the forefoot plate 218. Accordingly, the second end of the forefoot plate 304 extends beyond the second end 282 of the cushion 214, and is configured to cantilever with respect to the second end 282 of the cushion 214. As shown, the cushion 214 supports a substantial majority of a length of the forefoot plate 218 between the toe pad 210 and the second end 304 of the forefoot plate 218.

The second end 282 of the cushion 214 may be engaged by a retention feature 314 formed on the upper surface 306 of the forefoot plate 218. For example, the upper surface 306 may include a protuberance 314 or recess configured to cooperate with the second barrier element 290 to maintain a position of the cushion 214. With continued reference to FIG. 9, the cushion 214 extends continuously from the peripheral side surface 310 of the forefoot plate 218 on the medial side 22 to the peripheral side surface 310 of the forefoot plate 218 on the lateral side 24.

With reference to FIGS. 1 and 6A, the lower surface 308 of the forefoot plate 218 includes a plurality of the traction elements 224 extending therefrom. The traction elements 224 include integral traction elements 224*a* and attached traction elements 224*b*. The integral traction elements 224*a* are formed from the same material as the forefoot plate 218, and are formed unitary with the lower surface 308 during a molding process. In the illustrated example, the integral traction elements 224*a* are pyramidal in shape, and are formed as a first group adjacent the first end 302, and second group adjacent the second end 304, and a third group along the lateral side 24. The second group of the integral traction elements 224*a* may be arranged in a chevron configuration along the second end 304 of the forefoot plate 218.

In contrast to the integral traction elements 224*a*, the attached traction elements 224*b* are initially formed separately from the forefoot plate 218, and are fixed to the forefoot plate 218 during or after the molding process. As shown in FIGS. 3 and 9, the attached traction elements 224*b* may include a flange 316 and a spike 318 extending from the flange 316. In some examples, the flange 316 may include a plurality of radially arranged tabs configured to engage the material of the forefoot plate 218 to prevent rotation of the traction elements 224*b*. The spike 318 may be conical, and protrudes from the lower surface 308 of the forefoot plate 218.

In some examples, the flanges 316 of the attached traction elements 224*b* are encapsulated within the forefoot plate 218, intermediate the upper surface 306 and the lower surface 308. For example, during the molding process for forming the forefoot plate 218, the attached traction elements 224*b* may be initially provided to a forefoot plate mold such that the spike 318 is received through the mold surface corresponding to the lower surface 308 of the forefoot plate 218, while the flange 316 is spaced apart from the mold surface corresponding to the lower surface 308 of the forefoot plate 218. Molten material is then provided to the forefoot plate mold and encapsulates the flange 316 within the forefoot plate 218, while the spike 318 extends through the forefoot plate 218 and protrudes from the lower surface 308, as shown in FIG. 9. The forefoot plate 218 may include areas of increased thickness, or bulges, corresponding to the locations of the flanges 316.

Additionally or alternatively, the attached traction elements 224*b* may be removably attached to the forefoot plate 218, such that the attached traction elements 224*b* can be replaced. For example, the forefoot plate 218 may have threaded bushings including flanges (not shown) that are encapsulated within the forefoot plate 218 in a similar fashion as described above with respect to the flange 316. The threaded bushing may be exposed through the lower surface 308 of the forefoot plate 218, such that corresponding threads of a traction element 224 can engage the threaded bushing to removably secure the traction element 224.

With reference to FIG. 6A, the attached traction elements 224*b* are arranged in areas of the forefoot plate 218 associated with the midsole 208. For example, a first pair of the attached traction elements 224*b* is arranged in the toe portion 12T of the sole structure 200, and are aligned with the toe pad 210. A second pair of the attached traction elements 224*b* is associated with the first end 280 of the cushion, and includes a first attached traction element 224*b* adjacent the medial side 22 and another attached traction element 224*b* adjacent the lateral side 24. Another group of four attached traction elements 224*b* is spaced along a width of the forefoot plate 218 from the medial side 22 to the lateral side 24, and is associated with an intermediate region of the cushion 214.

The lower surface 308 may be serrated and includes a plurality of corrugations 320 defined by alternating ridges and flutes. As shown in FIGS. 1 and 6A, forefoot plate 218 includes a first plurality of corrugations 320*a* formed in the toe portion 12T, which extend along a direction from the medial side 22 to the lateral side 24, substantially perpendicular to the longitudinal axis $A_L$ of the footwear 10. A second plurality of corrugations 320*b* is formed between the medial side 22 and an intermediate portion of the lower surface 308 between the medial side 22 and the lateral side 24. The second plurality of corrugations 320*b* extend along a second direction at a first oblique angle with respect to the longitudinal axis $A_L$. A third plurality of the corrugations 320*c* is formed between the lateral side 24 and the intermediate portion of the lower surface 308, and extend along a third direction at a second oblique angle with respect to the longitudinal axis $A_L$. As shown, the first oblique angle of the second plurality of corrugations 320*b* is greater than the second oblique angle of the third plurality of corrugations 320*c*.

The first plurality of corrugations 320*a* may be spaced apart from the second and third pluralities of corrugations 320*b*, 320*c* along region of the lower surface 308 corresponding to the gap 284 between the toe pad 210 and the cushion 214. For example, as shown in FIG. 6A, a band 322 of the lower surface 308 extends continuously and uninterrupted from the medial side 22 to the lateral side 24, and is aligned with the gap 284 such that the band 322 provides a flexure bearing or living hinge between the fixed first end 302 and the second end 304.

Figure 13:
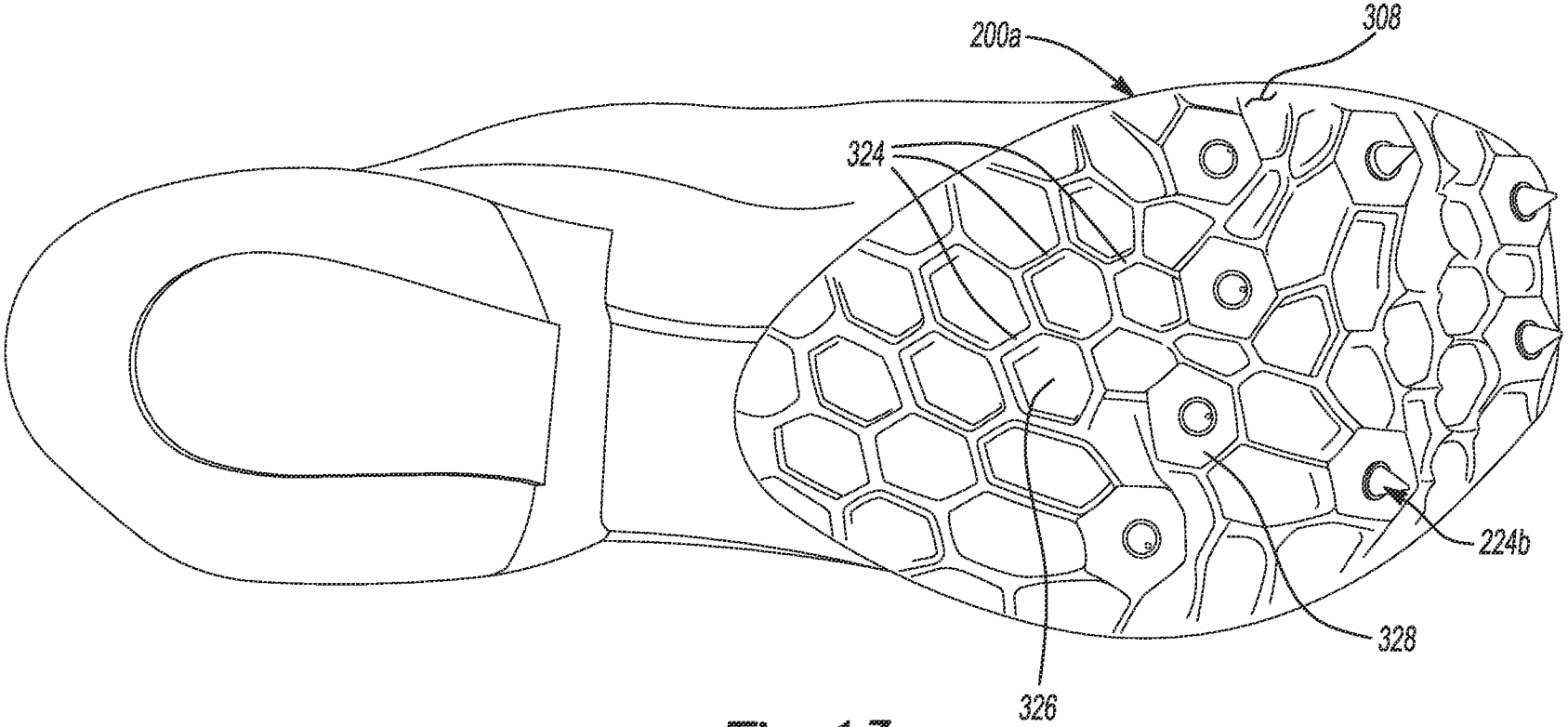
FIG. 13 is a bottom plan view of the article of footwear of FIG. 11.
Figure 14:
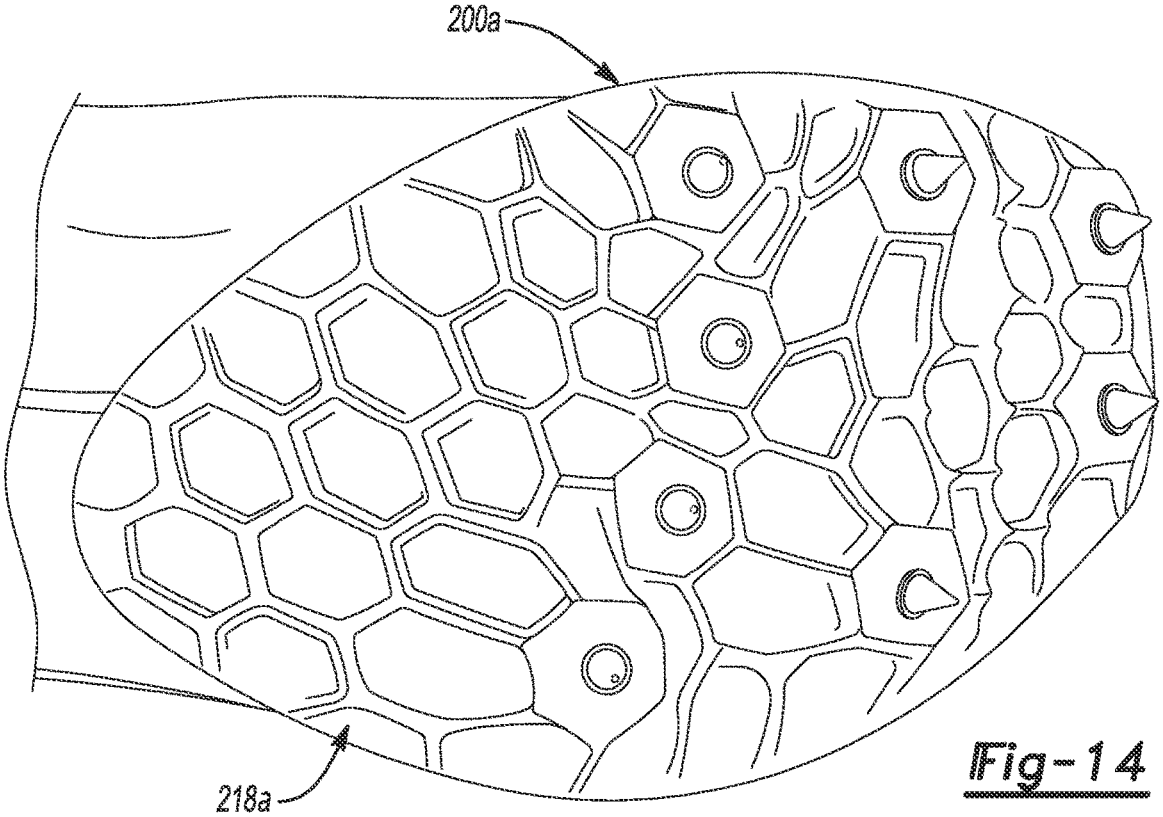
FIG. 14 is an enlarged bottom plan view of the article of footwear of FIG. 11.
Figure 15:
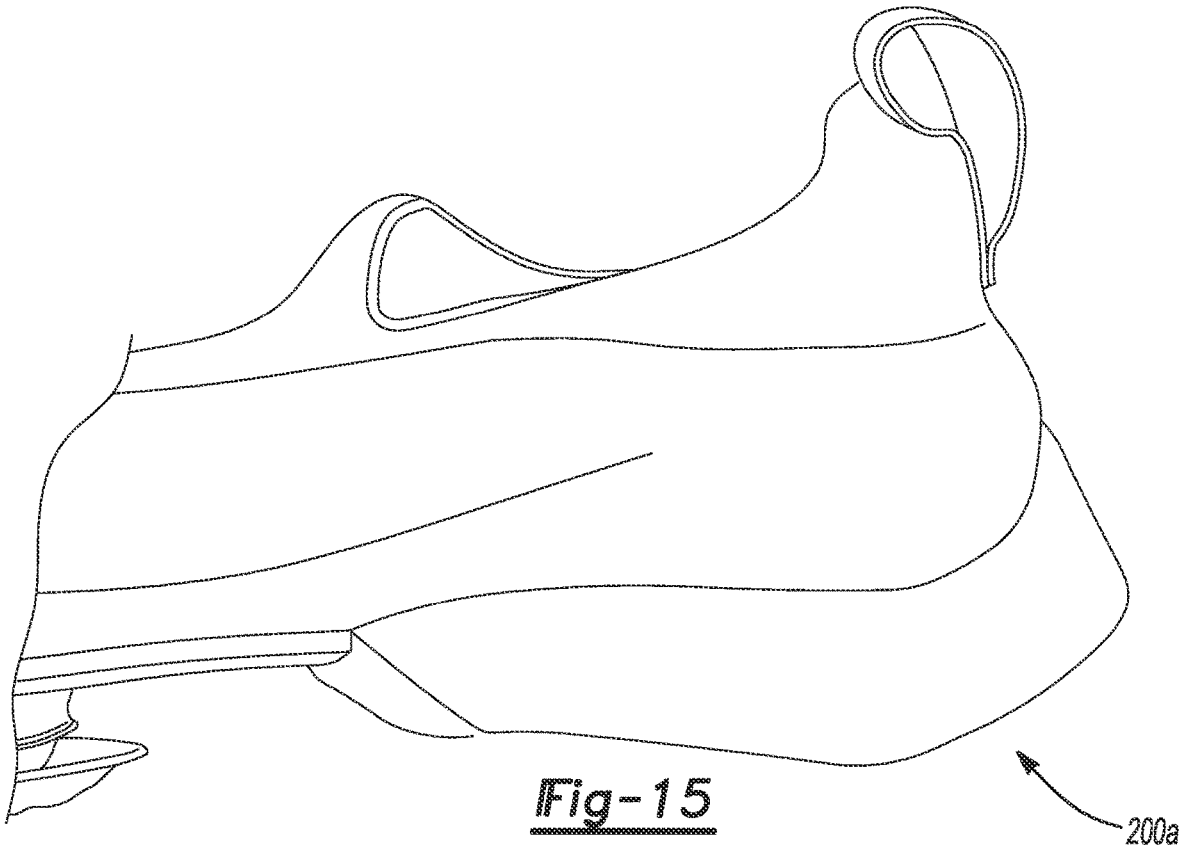
FIG. 15 is an enlarged lateral side elevation view of the article of footwear of FIG. 11.

In another example of the sole structure 200*a*, the forefoot plate 218*a* includes a plurality of ribs 324 extending from the lower surface 308, as shown in FIGS. 13 and 14. The ribs 324 are interconnected with each other and form a network of the ribs 324 extending along an entirety of the lower surface 308 of the forefoot plate. In the illustrated example, the ribs 324 may be arranged in a honeycombed-shaped network, including a plurality of polygonal (e.g. hexagonal) voids 326. In some examples, the lower surface 308 includes a plurality of protrusions 328 configured to provide areas of increased thickness along the forefoot plate 218. For example, the protrusions 328 may be integrated within the network of the ribs 324, such that a plurality of the ribs 324 define an outer periphery of the protrusion and/or emanate from the protrusions 328. The ribs 324 and the protrusions 328 may cooperate to define the ground-engaging surface 222 of the forefoot plate 218. Alternatively, the ribs 324 and the protrusions 328 may be described as defining a secondary surface spaced apart from the lower surface 308 (i.e. bottom of the voids 326) of the forefoot plate 218.

Figure 16:
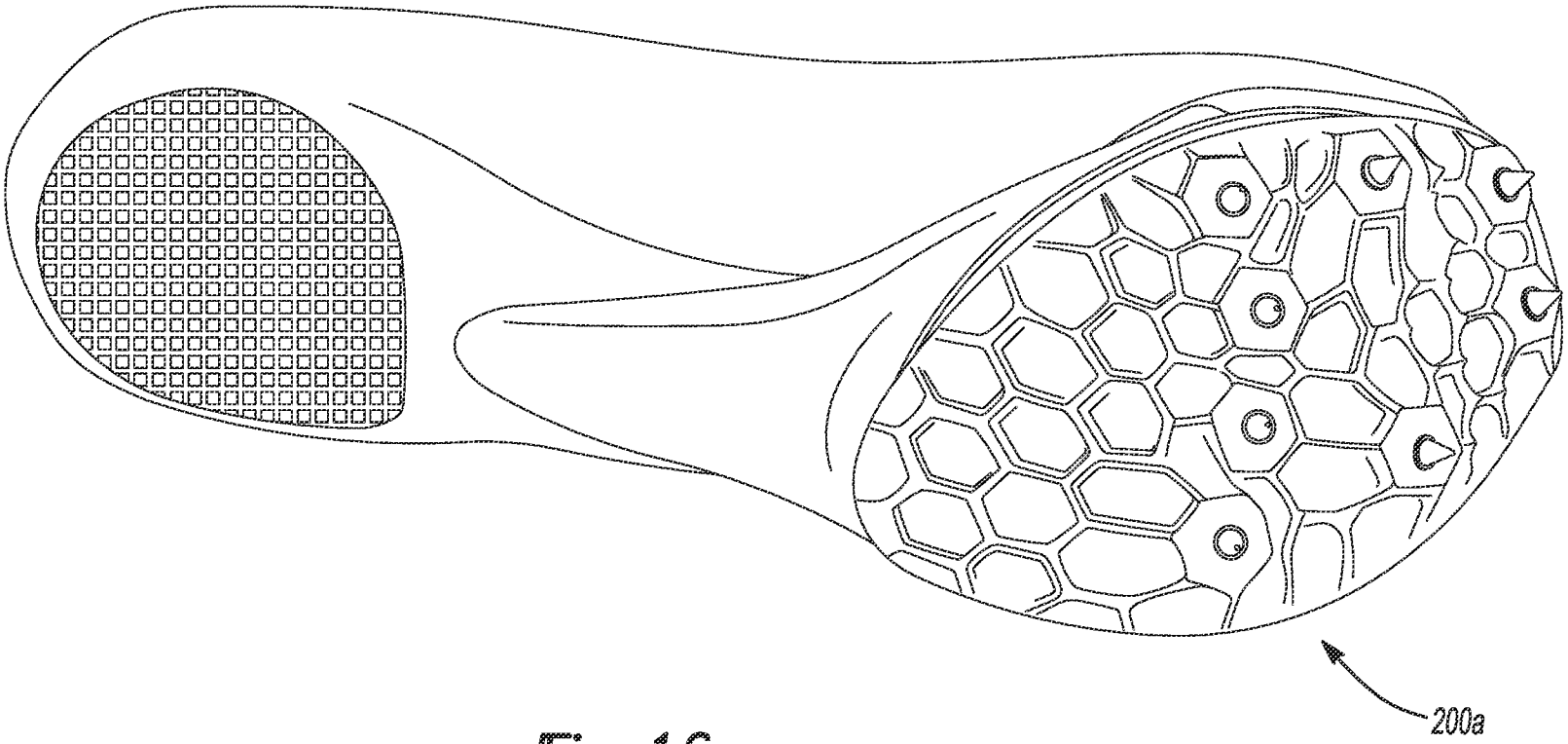
FIG. 16 is a bottom plan view of an article of footwear incorporating a sole structure in accordance with the principles of the present disclosure.
Figure 17:
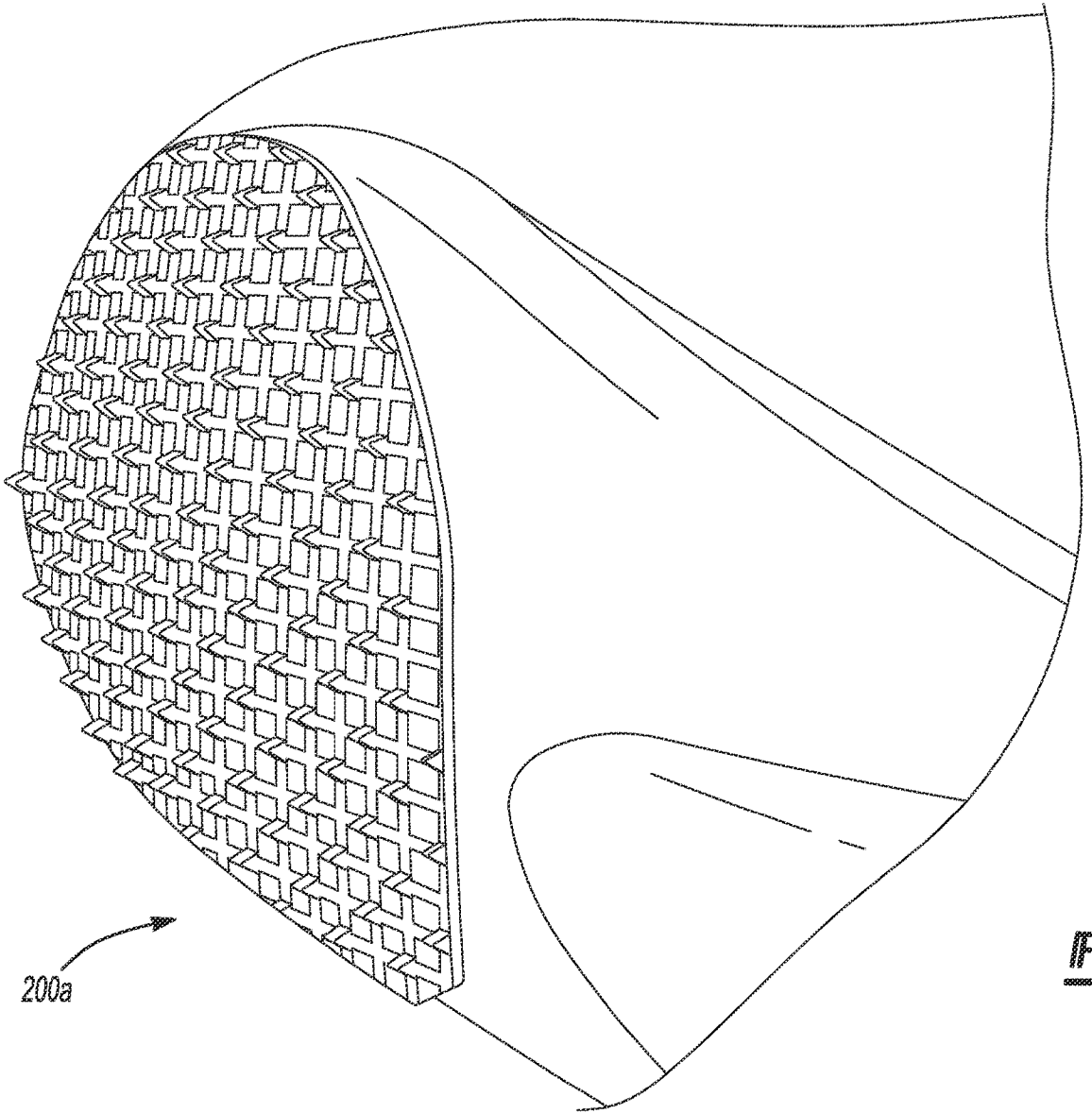
FIG. 17 is an enlarged perspective view of the article of footwear of FIG. 16.

As discussed above, the protrusions 328 are configured to receive the detachable traction elements 224*b*. As shown in FIG. 16, the protrusions 328 may have bushings 330 embedded therein. For example, the bushings may include a helically-threaded receptacle, configured to receive a threaded stud of a traction element 224.

With reference to FIGS. 1-3, the heel plate 220 may be attached to the surface feature 276 of the heel pad 212, and includes a plurality of the traction elements 224 formed therein. In some examples, the heel plate 220 may be adhesively bonded to the heel pad 212. Additionally or alternatively, the heel plate 220 may be at least partially embedded within the heel pad 212, or may be melded to the heel pad 212.

During operation, when the ground-engaging surface 222 contacts the ground, a force is transmitted via the outsole 216 to the midsole 208. Namely, the force is transmitted from the forefoot plate 218 to the cushion 214. The applied force causes the cushion 214 to compress, thereby absorbing the forces associated with the outsole 216 contacting the ground. The force is transmitted to the cushion 214 and the chassis 202 but is not experienced by the user as a point or localized load. Namely, and as described above, the chassis 202 is described as being formed from one or more rigid materials. Accordingly, even though the cushion 214 is located at a discrete area of the sole structure 200, the forces exerted on the chassis 202—particularly on the chassis plate 204—by the cushion 214 are dissipated over a length of the sole structure 200 such that the applied forces are not localized along the foot of the user. Rather, the forces applied at the location of the cushion 214 are dissipated along a length of the chassis plate 204 due to the rigidity of the chassis plate 204 and, as such, point loads are not experienced by the user's foot when the foot is in contact with an insole 108 disposed within the interior void 102.

The following Clauses provide configurations for an article of footwear described above.

Clause 1: A sole structure for an article of footwear having an upper, the sole structure comprising a first plate having a first surface facing away from the upper, the first plate including a forefoot region at an anterior end of the first plate, a heel region at a posterior end of the first plate, and a mid-foot region intermediate the forefoot region and the heel region; a second plate having a second surface opposing the first surface of the first plate, the second plate having a first end attached at the forefoot region of the first plate, and the second plate extending to a second end that is spaced apart from the first surface of the first plate; and a cushion disposed between the first plate and the second plate in the forefoot region and having a first side attached to the first surface of the first plate and a second side attached to the second surface of second plate, the cushion extending from a medial side of the sole structure to a lateral side of the sole structure.

Clause 2: The sole structure of Clause 1, wherein the cushion comprises a fluid-filled bladder.

Clause 3: The sole structure of Clause 2, wherein the fluid-filled bladder includes a tensile member disposed therein.

Clause 4: The sole structure of Clause 2, wherein the fluid-filled bladder is pressurized.

Clause 5: The sole structure of Clause 2, wherein the fluid-filled bladder is at a pressure between 15 psi and 25 psi.

Clause 6: The sole structure of Clause 2, wherein the fluid-filled bladder is at a pressure between 20 psi and 25 psi.

Clause 7: The sole structure of Clause 2, wherein the fluid-filled bladder is at a pressure of 20 psi.

Clause 8: The sole structure of Clause 2, wherein fluid-filled bladder is at a pressure of 25 psi.

Clause 9: The sole structure of Clause 1, wherein the cushion extends continuously from the medial side of the sole structure to the lateral side of the sole structure.

Clause 10: The sole structure of Clause 1, further comprising a toe pad disposed between the first plate and the second plate and disposed at the anterior end of the first plate.

Clause 11: The sole structure of Clause 10, wherein the first end of the second plate is attached to the toe pad.

Clause 12: The sole structure of Clause 10, wherein the toe pad is formed of a foamed polymeric material.

Clause 13: The sole structure of Clause 10, wherein a first surface of the toe pad is attached to the first surface of the first plate and a second surface of the toe pad is attached to the second surface of the second plate.

Clause 14: The sole structure of Clause 13, wherein the first surface of the toe pad and the second surface of the toe pad diverge from each other along a direction from the anterior end of the first plate to the posterior end of the first plate.

Clause 15: The sole structure of Clause 10, wherein the toe pad includes a groove extending from the medial side of the sole structure to the lateral side of the sole structure.

Clause 16: The sole structure of Clause 10, wherein the cushion is spaced apart from the toe pad by a gap, the gap extending continuously from the medial side to the lateral side.

Clause 17: The sole structure of Clause 1, wherein the first plate is formed of a composite material and the second plate is formed of a polymeric material.

Clause 18: The sole structure of Clause 17, wherein the composite material comprises a carbon fiber material and a binder.

Clause 19: The sole structure of Clause 1, wherein the first plate includes fiber bundles arranged on a substrate.

Clause 20: The sole structure of Clause 1, wherein the first plate includes unidirectional tape.

Clause 21: The sole structure of Clause 1, wherein the first plate is formed by an injection molding process.

Clause 22: The sole structure of Clause 1, wherein the second plate includes a third surface formed on an opposite side of the second plate than the second surface and including a plurality of traction elements protruding therefrom.

Clause 23: The sole structure of Clause 22, wherein at least one of the traction elements includes a flange attached to the second plate.

Clause 24: The sole structure of Clause 23, wherein the flange is attached between the second surface and the third surface of the second plate.

Clause 25: The sole structure of Clause 24, wherein the flange is encapsulated in the second plate.

Clause 26: The sole structure of Clause 23, further comprising a spike extending from the flange and from the third surface.

Clause 27: The sole structure of Clause 26, wherein the spike is removably attached to the flange.

Clause 28: The sole structure of Clause 26, wherein the spike is integrally formed with the flange.

Clause 29: The sole structure of Clause 22, wherein the second plate includes a receptacle attached to the second plate.

Clause 30: The sole structure of Clause 29, wherein the receptacle is attached between the second surface and the third surface of the second plate.

Clause 31: The sole structure of Clause 30, wherein the receptacle includes a retention feature exposed through the third surface of the second plate.

Clause 32: The sole structure of Clause 31, wherein a traction element is removably received by the retention feature.

Clause 33: The sole structure of Clause 32, wherein the retention feature is a helical thread.

Clause 34: The sole structure of Clause 22, wherein the plurality of traction elements include primary traction elements and secondary traction elements.

Clause 35: The sole structure of Clause 34, wherein the secondary traction elements are integrally formed with the third surface of the second plate.

Clause 36: The sole structure of Clause 1, wherein the second plate includes a third surface formed on an opposite side of the second plate than the second surface and including a network of ribs protruding from the third surface.

Clause 37: The sole structure of Clause 36, wherein the third surface of the second plate includes a protrusion disposed within the network of ribs, the protrusion configured to receive a traction element.

Clause 38: The sole structure of Clause 37, wherein the protrusion and the network of ribs cooperate to define a ground-engaging surface.

Clause 39: The sole structure of Clause 1, wherein the second end of the second plate is cantilevered off of a posterior end of the cushion.

Clause 40: The sole structure of Clause 1, wherein the second plate is cantilevered from the anterior end of the first plate.

Clause 41: The sole structure of Clause 1, wherein the first end of the second plate extends upwardly at the anterior end of the first plate and forms a toe cap.

Clause 42: The sole structure of Clause 1, wherein a majority of a length of the second plate is supported by the cushion, the length extending from the first end of the second plate to the second end of the second plate.

Clause 43: The sole structure of Clause 1, further comprising a midsole including a toe pad disposed in a toe portion of the mid-foot region and a cushion disposed in the heel region.

Clause 44: The sole structure of Clause 1, further comprising a shank attached to the first surface of the first plate, the shank extending from an anterior end disposed between the first plate and the cushion to a posterior end of the shank adjacent the heel region.

Clause 45: The sole structure of Clause 44, wherein the shank includes a protuberance having an outer periphery offset inwardly from an outer periphery of the shank, an anterior end of the protuberance spaced apart from and complementary to an outer periphery of the cushion.

Clause 46: The sole structure of Clause 1, further comprising a heel pad attached to the second surface of the first plate at the posterior end.

Clause 47: The sole structure of Clause 46, wherein the heel pad includes a plurality of traction elements.

Clause 48: The sole structure of Clause 47, wherein the traction elements of the heel pad are arranged in alternating rows and columns.

Clause 49: A sole structure for an article of footwear having an upper, the sole structure comprising first plate having a first surface, the first plate including a forefoot region at an anterior end of the first plate, a heel region at a posterior end of the first plate, and a mid-foot region intermediate the forefoot region and the heel region; a second plate having a second surface opposing the first surface of the first plate, the second plate having a first end attached to the forefoot region of the first plate and extending to a second end that is spaced apart from the first surface of the first plate; and a cushion having a first side attached to the first surface of the first plate and a second side attached to the second surface of second plate, the cushion extending from a first peripheral side surface of the second plate to an opposing second peripheral side surface of the second plate.

Clause 50: The sole structure of Clause 49, wherein the cushion comprises a fluid-filled bladder.

Clause 51: The sole structure of Clause 50, wherein the fluid-filled bladder includes a tensile member disposed therein.

Clause 52: The sole structure of Clause 50, wherein the fluid-filled bladder is pressurized.

Clause 53: The sole structure of Clause 50, wherein the fluid-filled bladder is at a pressure between 15 psi and 25 psi.

Clause 54: The sole structure of Clause 50, wherein the fluid-filled bladder is at a pressure between 20 psi and 25 psi.

Clause 55: The sole structure of Clause 50, wherein the fluid-filled bladder is at 20 psi.

Clause 56: The sole structure of Clause 50, wherein the fluid-filled bladder is at 25 psi.

Clause 57: The sole structure of Clause 49, wherein the cushion extends continuously from a medial side of the sole structure to a lateral side of the sole structure.

Clause 58: The sole structure of Clause 49, further comprising a toe pad disposed between the first plate and the second plate and disposed at the anterior end of the first plate.

Clause 59: The sole structure of Clause 58, wherein the first end of the second plate is attached to the toe pad.

Clause 60: The sole structure of Clause 58, wherein the toe pad is formed of a foamed polymeric material.

Clause 61: The sole structure of Clause 58, wherein a first surface of the toe pad is attached to the first surface of the first plate and a second surface of the toe pad is attached to the second surface of the second plate.

Clause 62: The sole structure of Clause 61, wherein the first surface of the toe pad and the second surface of the toe pad diverge from each other along a direction from the anterior end of the first plate to the posterior end of the first plate.

Clause 63: The sole structure of Clause 58, wherein the toe pad includes a groove extending from a medial side of the sole structure to a lateral side of the sole structure.

Clause 64: The sole structure of Clause 58, wherein the cushion is spaced apart from the toe pad by a gap, the gap extending continuously from a medial side of the sole structure to a lateral side of the sole structure.

Clause 65: The sole structure of Clause 49, wherein the first plate is formed of a composite material and the second plate is formed of a polymeric material.

Clause 66: The sole structure of Clause 65, wherein the composite material comprises a carbon fiber material and a binder.

Clause 67: The sole structure of Clause 49, wherein the first plate includes fiber bundles arranged on a substrate.

Clause 68: The sole structure of Clause 49, wherein the first plate includes unidirectional tape.

Clause 69: The sole structure of Clause 49, wherein the first plate is formed by an injection molding process.

Clause 70: The sole structure of Clause 49, wherein the second plate includes a third surface formed on an opposite side of the second plate than the second surface and including a plurality of traction elements protruding therefrom.

Clause 71: The sole structure of Clause 70, wherein at least one of the traction elements includes a flange attached to the second plate.

Clause 72: The sole structure of Clause 71, wherein the flange is attached between the second surface and the third surface of the second plate.

Clause 73: The sole structure of Clause 72, wherein the flange is encapsulated in the second plate.

Clause 74: The sole structure of Clause 71, further comprising a spike extending from the flange and from the third surface.

Clause 75: The sole structure of Clause 74, wherein the spike is removably attached to the flange.

Clause 76: The sole structure of Clause 74, wherein the spike is integrally formed with the flange.

Clause 77: The sole structure of Clause 70, wherein the second plate includes a receptacle attached to the second plate.

Clause 78: The sole structure of Clause 77, wherein the receptacle is attached between the second surface and the third surface of the second plate.

Clause 79: The sole structure of Clause 78, wherein the receptacle includes a retention feature exposed through the third surface of the second plate.

Clause 80: The sole structure of Clause 79, wherein a traction element is removably received by the retention feature.

Clause 81: The sole structure of Clause 80, wherein the retention feature is a helical thread.

Clause 82: The sole structure of Clause 70, wherein the plurality of traction elements include primary traction elements and secondary traction elements.

Clause 83: The sole structure of Clause 82, wherein the secondary traction elements are integrally formed with the third surface of the second plate.

Clause 84: The sole structure of Clause 49, wherein the second plate includes a third surface formed on an opposite side of the second plate than the second surface and including a network of ribs protruding from the third surface.

Clause 85: The sole structure of Clause 84, wherein the third surface of the second plate includes a protrusion disposed within the network of ribs, the protrusion configured to receive a traction element.

Clause 86: The sole structure of Clause 85, wherein the protrusion and the network of ribs cooperate to define a ground-engaging surface.

Clause 87: The sole structure of Clause 49, wherein the second end of the second plate is cantilevered off of a posterior end of the cushion.

Clause 88: The sole structure of Clause 49, wherein the second plate is cantilevered from the anterior end of the first plate.

Clause 89: The sole structure of Clause 49, wherein the first end of the second plate extends upwardly at the anterior end of the first plate and forms a toe cap.

Clause 90: The sole structure of Clause 49, wherein a majority of a length of the second plate is supported by the cushion, the length extending from the first end of the second plate to the second end of the second plate.

Clause 91: The sole structure of Clause 49, further comprising a midsole including a toe pad disposed in a toe portion of the mid-foot region and a cushion disposed in the heel region.

Clause 92: The sole structure of Clause 49, further comprising a shank attached to the first surface of the first plate, the shank extending from an anterior end disposed between the first plate and the cushion to a posterior end of the shank adjacent the heel region.

Clause 93: The sole structure of Clause 92, wherein the shank includes a protuberance having an outer periphery offset inwardly from an outer periphery of the shank, an anterior end of the protuberance spaced apart from and complementary to an outer periphery of the cushion.

Clause 94: The sole structure of Clause 49, further comprising a heel pad attached to the second surface of the first plate at the posterior end.

Clause 95: The sole structure of Clause 94, wherein the heel pad includes a plurality of traction elements.

Clause 96: The sole structure of Clause 95, wherein the traction elements of the heel pad are arranged in alternating rows and columns.

The foregoing description of the embodiments has been provided for purposes of illustration and description. It is not intended to be exhaustive or to limit the disclosure. Individual elements or feature of a particular embodiment are generally not limited to that particular embodiment, but, where applicable, are interchangeable and can be used in a selected embodiment, even if not specifically shown or described. The same may also be varied in many ways. Such variations are not to be regarded as a departure from the disclosure, and all such modifications are intended to be included within the scope of the disclosure.

What is claimed is:

1. A sole structure for an article of footwear having an upper, the sole structure comprising:

a first plate having a first surface facing away from the upper, the first plate including a forefoot region at an anterior end of the first plate, a heel region at a posterior end of the first plate, and a mid-foot region intermediate the forefoot region and the heel region;

a second plate having (i) a second surface opposing the first surface of the first plate, (ii) a first end attached at the forefoot region of the first plate, and (iii) a second end tapering in a direction toward the heel region of the first plate and spaced apart from the first surface of the first plate; and a cushion disposed between the first plate and the second plate in the forefoot region and having a first side attached to the first surface of the first plate and defining a first curved surface and a second side attached to the second surface of the second plate and defining a second curved surface having the same curvature as the first curved surface to provide the cushion with a substantially constant thickness, the cushion extending from a medial side of the sole structure to a lateral side of the sole structure.

2. The sole structure of claim 1, wherein the cushion comprises a fluid-filled bladder.

3. The sole structure of claim 2, wherein the fluid-filled bladder includes a tensile member disposed therein.

4. The sole structure of claim 2, wherein the fluid-filled bladder is pressurized.

5. The sole structure of claim 1, further comprising a toe pad disposed between the first plate and the second plate at the anterior end of the first plate.

6. The sole structure of claim 1, wherein the first plate is formed of a composite material and the second plate is formed of a polymeric material.

7. The sole structure of claim 1, wherein the second plate includes a third surface formed on an opposite side of the second plate than the second surface and including a plurality of traction elements protruding therefrom.

8. The sole structure of claim 1, wherein the second end of the second plate is cantilevered off of a posterior end of the cushion.

9. The sole structure of claim 1, wherein the first end of the second plate extends upwardly at the anterior end of the first plate and forms a toe cap.

10. The sole structure of claim 1, wherein a majority of a length of the second plate is supported by the cushion, the length extending from the first end of the second plate to the second end of the second plate.

11. A sole structure for an article of footwear having an upper, the sole structure comprising:

a first plate having a first surface, the first plate including a forefoot region at an anterior end of the first plate, a heel region at a posterior end of the first plate, and a mid-foot region intermediate the forefoot region and the heel region;

a second plate having (i) a second surface opposing the first surface of the first plate, (ii) a first end attached to the forefoot region of the first plate, and (iii) a second end tapering in a direction toward the heel region of the first plate and spaced apart from the first surface of the first plate; and a cushion having a first side attached to the first surface of the first plate and defining a first curved surface and a second side attached to the second surface of the second plate and defining a second curved surface having the same curvature as the first curved surface to provide the cushion with a substantially constant thickness, the cushion extending from a first peripheral side surface of the second plate to an opposing second peripheral side surface of the second plate.

12. The sole structure of claim 11, wherein the cushion comprises a fluid-filled bladder.

13. The sole structure of claim 12, wherein the fluid-filled bladder includes a tensile member disposed therein.

14. The sole structure of claim 12, wherein the fluid-filled bladder is pressurized.

15. The sole structure of claim 11, further comprising a toe pad disposed between the first plate and the second plate at the anterior end of the first plate.

16. The sole structure of claim 11, wherein the first plate is formed of a composite material and the second plate is formed of a polymeric material.

17. The sole structure of claim 11, wherein the second plate includes a third surface formed on an opposite side of the second plate than the second surface and including a plurality of traction elements protruding therefrom.

18. The sole structure of claim 11, wherein the second end of the second plate is cantilevered off of a posterior end of the cushion.

19. The sole structure of claim 11, wherein the first end of the second plate extends upwardly at the anterior end of the first plate and forms a toe cap.

20. The sole structure of claim 11, wherein a majority of a length of the second plate is supported by the cushion, the length extending from the first end of the second plate to the second end of the second plate.

* * * * *